United States Patent [19]

Kaneko

[11] Patent Number: 4,887,060

[45] Date of Patent: Dec. 12, 1989

[54] SHEET DISCHARGE DEVICE

[75] Inventor: Tamaki Kaneko, Fujisawa, Japan

[73] Assignee: O/A Technologies Inc., Irvine, Calif.

[21] Appl. No.: 332,374

[22] Filed: Apr. 3, 1989

Related U.S. Application Data

[63] Continuation of Ser. No. 32,018, Mar. 30, 1987, abandoned.

[30] Foreign Application Priority Data

| | | | |
|---|---|---|---|
| Sep. 29, 1986 | [JP] | Japan | 61-230891 |
| Sep. 30, 1986 | [JP] | Japan | 61-232791 |
| Oct. 20, 1986 | [JP] | Japan | 61-247453 |
| Oct. 20, 1986 | [JP] | Japan | 61-247454 |
| Oct. 20, 1986 | [JP] | Japan | 61-247455 |
| Oct. 20, 1986 | [JP] | Japan | 61-247456 |

[51] Int. Cl.[4] ..... G03G 15/00

[52] U.S. Cl. ..... 355/323; 355/321; 355/322; 271/296; 271/186

[58] Field of Search ..... 355/323, 321, 322, 325, 355/308, 309; 271/186, 296, 303, 305

[56] References Cited

U.S. PATENT DOCUMENTS

| | | | |
|---|---|---|---|
| 4,405,225 | 9/1983 | Perrault | 355/3 SH X |
| 4,515,458 | 5/1985 | Masuda et al. | 355/3 SH |
| 4,586,812 | 5/1986 | Kaneko et al. | 355/3 SH X |
| 4,723,148 | 2/1988 | Hamakawa | 355/3 SH X |

FOREIGN PATENT DOCUMENTS 55-66453 5/1980 Japan .

*Primary Examiner*—A. C. Prescott

*Attorney, Agent, or Firm*—Oblon, Spivak, McClelland, Maier & Neustadt

[57] ABSTRACT

A sheet discharge device carrying to sheet trays recorded sheets sent from an electrostatic copying machine, facsimile and other sheet handling devices. Each sheet discharged from a sheet handling device is pinched by a movable member, carried to one of sheet trays by moving the movable member to the sheet tray, and then discharged thereon. The sheet carry direction is changed by a desirable angle before discharging the sheet on the sheet tray.

11 Claims, 31 Drawing Sheets

SHEET DISCHARGE DEVICE

This application is a continuation of application Ser. No. 032,018 filed on Mar. 30, 1987, now abandoned.

BACKGROUND OF THE INVENTION

1. Field of the Invention

This invention relates to a sheet discharge device which transfers sheets of paper discharged from an electrostatic copying machine, printer and other sheet handling devices to a plurality of sheet trays. This kind of sheet discharge devices includes a sorter which distributes sheets successively discharged from a sheet handling device to sheet trays.

2. Discussion of the Background

Heretofore there has been known a sorter which consists of a plurality of bins vertically disposed at given intervals, a recorded paper carrier having a belt disposed close to the bins to carry recorded sheets of paper upwards or downwards and a suction fan drawing the recorded sheets into the belt, a lift member disposed and vertically movable between the recorded paper carrier and the bins, a lift driver raising the lift member, a direction changer disposed at the lift member to direct to a desired bin a traveling direction of recorded sheets of paper being transferred by the recorded paper carrier, and a pair of paper discharge rollers disposed at the lift member to discharge on a desired bin recorded sheets whose direction was changed by the direction changer.

The aforesaid sorter, however, must change a transfer direction of recorded sheets of paper on a recorded paper carrier for a variety of discharge position heights of recorded sheets in an image recording device, one of the sheet handling devices. For example, the belt must be transferred from a lower to an upper position recorded sheets are discharged at the lower position of the image recording device, and on the other hand the belt must be transferred from an upper to a lower position discharged at the upper position. Therefore, a direction configuration must be changed over for one case where the direction of recorded sheets has been transferred from a lower direction and for another case where the direction of recorded sheets has been transferred from an upper direction. Such switching of the direction change member configuration is extremely troublesome.

In addition, the direction change member, which must change the direction of recorded sheet being transferred from either upper and, lower directions, may involve an extremely complicated configuration.

OBJECT AND SUMMARY OF THE INVENTION

In view of the above, it is an object and purpose of the invention to provide a sheet discharge device which can readily sort, on a plurality of sheet trays, recorded sheets of paper discharged from a variety of sheet discharge positions of a sheet handling device, without changing the configuration.

Furthermore, it is the other object and purpose of the invention to provide a sheet discharge device which can decide a sheet transfer direction to meet a condition of sheet tray position (for instance, a sheet tray may be placed horizontally, or slanted toward lower, or slanted toward upper).

In a sheet discharge device according to the invention in which discharged sheets from a sheet handling device are transferred to sheet trays, the aforesaid objects can be accomplished by providing a movable member moving between the aforesaid sheet tray and a home position corresponding to a sheet discharge port of the sheet handling device, a sheet pincher disposed at the aforesaid movable member and momentarily holding discharged sheets from the aforesaid sheet handling device, a sheet discharger disposed at the aforesaid movable member and transferring to discharge momentarily held sheets by the aforesaid sheet pincher, a sheet carry direction changer disposed at the aforesaid movable member and changing a carrying direction of the sheets carried by the aforesaid sheet discharger, and by first placing the aforesaid movable member at the aforesaid home position, then holding a sheet discharged from the sheet handling device by the aforesaid sheet pincher, carrying the aforesaid movable member to the aforesaid sheet tray while holding the sheet, and further changing a sheet carrying direction to a desired direction by the aforesaid sheet carry direction changer, and by finally discharging the sheet on the aforesaid sheet tray by the aforesaid sheet discharger.

BRIEF DESCRIPTION OF THE DRAWINGS

In the accompanying drawings, there are shown illustrative embodiments of the invention from which these and other of its objectives, novel features and advantages will be readily apparent.

In the drawings

THE DESCRIPTION OF PREFERRED EMBODIMENTS

Figure 1:
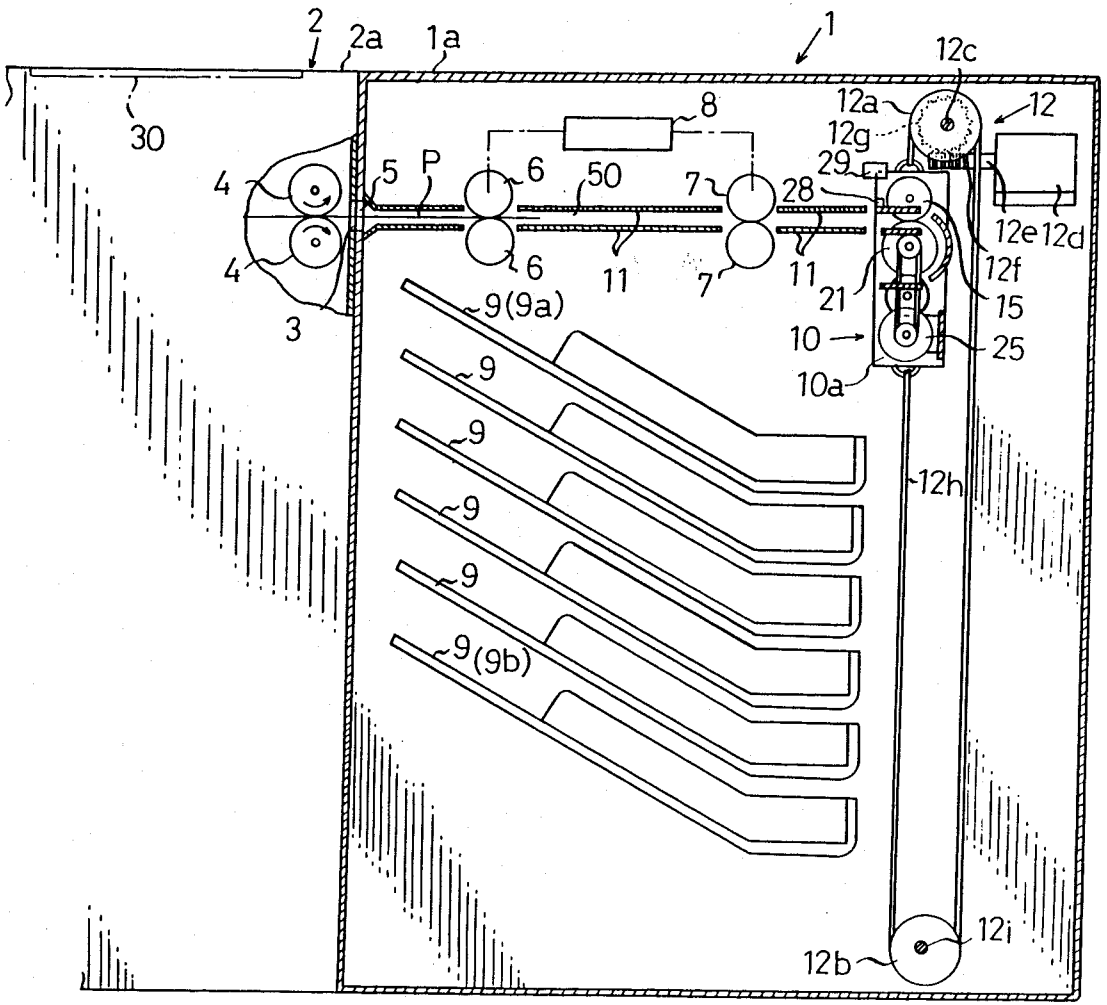
FIG. 1 is a side sectional view of the first embodiment.

In FIG. 1, numeral 1 indicates a sorter, one of typical sheet discharge devices. An electrostatic copying machine 2, one of typical sheet handling devices, is disposed in juxtaposition to an outer casing 1*a* of the sorter 1. On an outer casing 2*a* of the electrostatic copying machine 2, a sheet discharge port 3 is formed to discharge recorded sheets of paper P to the sorter 1. Inside the outer casing 2*a* in the vicinity of the sheet discharge port 3, a pair of sheet discharge rollers 4 is disposed.

Opposite to the sheet discharge port 3 on the outer casing 2*a* of the aforesaid electrostatic copying machine 2, a sheet receiving port 5 is formed on the outer casing 1*a* of the sorter 1. Pairs of sheet receiving rollers 6 and 7 are disposed inside the outer casing 1*a*. The sheet receiving rollers 6 and 7 are rotated by a receiving roller driver 8.

Under the aforesaid receiving rollers 6 and 7, a plurality of bins 9 are vertically disposed at given intervals, working as sheet trays. These bins 9 are supported by the outer casing 1*a*.

In the vicinity of the aforesaid bins 9 a movable member 10 is vertically movably disposed. Between the aforesaid sheet discharge rollers 4 and the movable member 10, a sheet guide member 11 is disposed to guide recorded sheets P. The aforesaid movable member 10 is raised by a lift driver 12, which consists of two pairs of upper and lower pulleys 12*a* and 12*b* disposed vertically apart and opposite each other, a reversible step motor 12*d* disposed close to a revolving shaft 12*c* of the upper pulleys 12*a*, a worm gear 12*f* fixed to a drive shaft 12*e* of the step motor 12*d*, a wheel gear 12*g* fixed to the revolving shaft 12*c* of the pulleys 12*a* to engage with the worm gear 12*f*, and a pair of wires 12*h* looped over the aforesaid pulleys 12*a* and 12*b* to which side plates 10*a* of the movable member 10 are fixed. FIG. 1 shows only one side plate 10*a*, but, as a matter of fact, another side plate 10*a*, the same plate as the side plate 10*a* shown in FIG. 1 is provided toward the viewer. From now on, "side plates 10*a*"is interpreted to another side plate tow and the view not shown in FIG. 1.

Both ends of the revolving shaft 12*c* and 12*i* of the respective pulleys 12*a* and 12*b* are supported with bearings (not shown) fixed to the outer casing 1*a*. The aforesaid step motor 12*d* is also fixed to the outer casing 1*a*.

Figure 2:
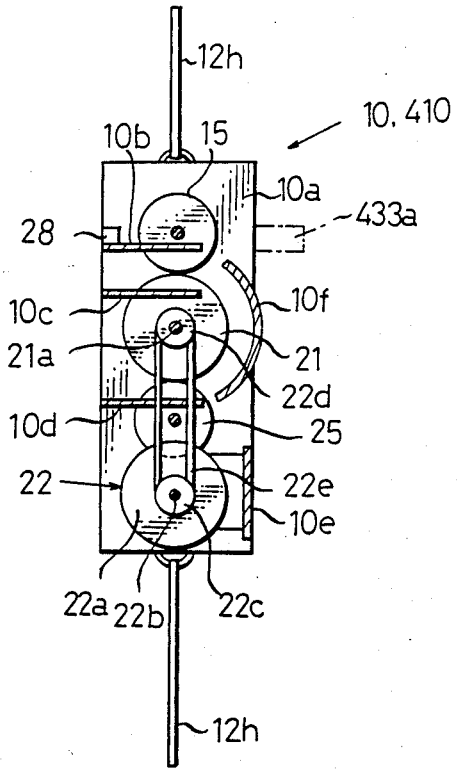
FIG. 2 is a sectional view of a movable member in the aforesaid first embodiment.

As shown in FIG. 2, the aforesaid movable member 10 consists of the side plates 10*a* and hold plates 10*b*, 10*c*, 10*d* and 10*e* integrally fixed thereto. Between the side plates 10*a*, a half-circular sheet guide member 10*f* is provided.

Figure 3:
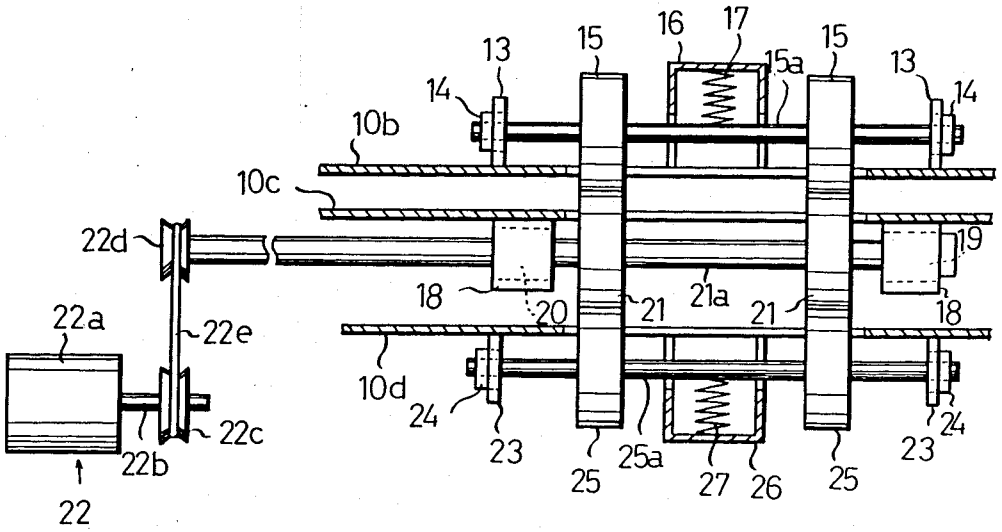
FIG. 3 is a front sectional view of the aforesaid movable member.

As shown in FIG. 3, on the upper hold plate 10*b* extend outwardly two support tongues 13, in which bearings 14 are disposed to vertically slide a slight distance in slotted holes. A revolving shaft 15*a* for first followers 15 is supported with the bearings 14. From the aforesaid hold plate 10*b* projects outwardly a hold plate 16, which houses a spring 17 to press down the revolving shaft 15*a* for the first followers 15.

From the aforesaid hold plate 10*c* also extend outwardly support tongues 18 that incorporate respectively a one-way clutch 19 and a bearing 20, by which is supported a revolving shaft 21*a* for main rollers 21. The main rollers 21 are rotated by a main roller driver 22, which consists of a motor 22*a* fixed to the hold plate 10*e* in the movable member 10, a pulley 22*c* secured to a drive shaft 22*b* of the motor 22*a*, another pulley 22*d* fixed to the revolving shaft 21*a* for the main rollers 21 opposite to the pulley 22*c*, and a belt 22*e* looped over these pulleys 22*c* and 22*d*. The aforesaid one-way clutch 19 permits the main rollers 21 to rotate in such a direction as to transfer recorded sheets P toward the bin 9, but does not permit the main rollers to rotate adversely to the aforesaid direction.

Below the aforesaid hold plate 10*d* also extend outwardlly two support tongues 23, in which bearings 24 are disposed to vertically slide a slight distance in their slotted holes. And a revolving shaft 25*a* for second followers 25 is supported with the bearings 24. From the aforesaid hold plate 10*d* projects out a hold plate 26, which houses a spring 27 to press down the revolving shaft 25*a* for the second followers 25.

In other words, respectively on and below the aforesaid main rollers 21 the respective first and second followers 15 and 25 are disposed to be pressed down thereto elastically. Following the aforesaid rotating main rollers 21, the first and second followers rotate to discharge recorded sheets P while pinching the sheets P being inserted in between.

In FIG. 1, on an insert side of the recorded sheets P of the aforesaid main rollers 21, a sheet sensor 28 as a sheet detecting means is disposed to detect a leading edge of the sheet P, which is a photosensor and is fixed to the hold plate 10*b*. To detect that the aforesaid main rollers 21 have been deployed to a home position where they receive recorded sheets P sent from the receive rollers 6 and 7, at a given point on the movable member 10 is disposed a roller home position sensor 29, which is also a photosensor to identify that the main rollers 21 have reached the home position by detecting that the side plate 10*a* on the movable member 10 has reached a desired position.

When a recorded sheet P is sent in between the aforesaid receive rollers 6 and 7 from the sheet discharge rollers 4 in the electrostatic copying machine 2, the receive rollers 6 and 7 transfer the recorded sheet P toward the main rollers 21 and the first followers 15. At the moment, the main rollers 21 and the first followers 15 stand by without rotation at a home position to receive a recorded sheet P (FIG. 1 shows a case where the home position is situated higher than the bin 9*a*). When the aforesaid sheet sensor 28 detects a leading edge of the recorded sheet P, the main rollers 21 rotate only for a short predetermined time sufficient to transfer the sheet P toward the bin 9 (clockwise in FIG. 1), until the main rollers 21 and the first and second followers 15 and 25 pinch the leading edge of the sheet P. Then the main rollers 21 come to a halt.

At the instant when the aforesaid main rollers 21 and the 1st and 2nd followers 15 and 25 have succeeded in pinching the recorded sheet P, the movable member 10 and the main rollers 21 come to a stop at a position matching a target bin 9 after moving thereto. While the movable member 10 and the main rollers 21 are moving, since the one-way clutch 19 (FIG. 3) does not permit the main rollers 21 to rotate in a direction adverse to such one as to send the recorded sheet P toward the bin 9, there is no chance of the sheet P escaping the main rollers 21. The speed of the main rollers 21 in moving toward a target bin 9 is set at a speed similar to a sheet feed speed of the sheet discharge rollers 4 in an electrostatic copying machine 2.

On having come to a position matching a target bin 9, the aforesaid main rollers 21 begin again to rotate to discharge a recorded sheet P onto the bin 9, and stop rotation a certain short time after the sheet sensor's 28 detection of a trailing edge of the sheet P to return back the movable member 10 and the main rollers 21 to the original home position, when the return speed thereof may be larger than a feed speed of recorded sheets P by the sheet discharge rollers 4 in an electrostatic copying machine 2 to obtain a high speed cycle, because this time the main rollers 21 have nothing to do with the pinching of sheets P.

Figure 4:
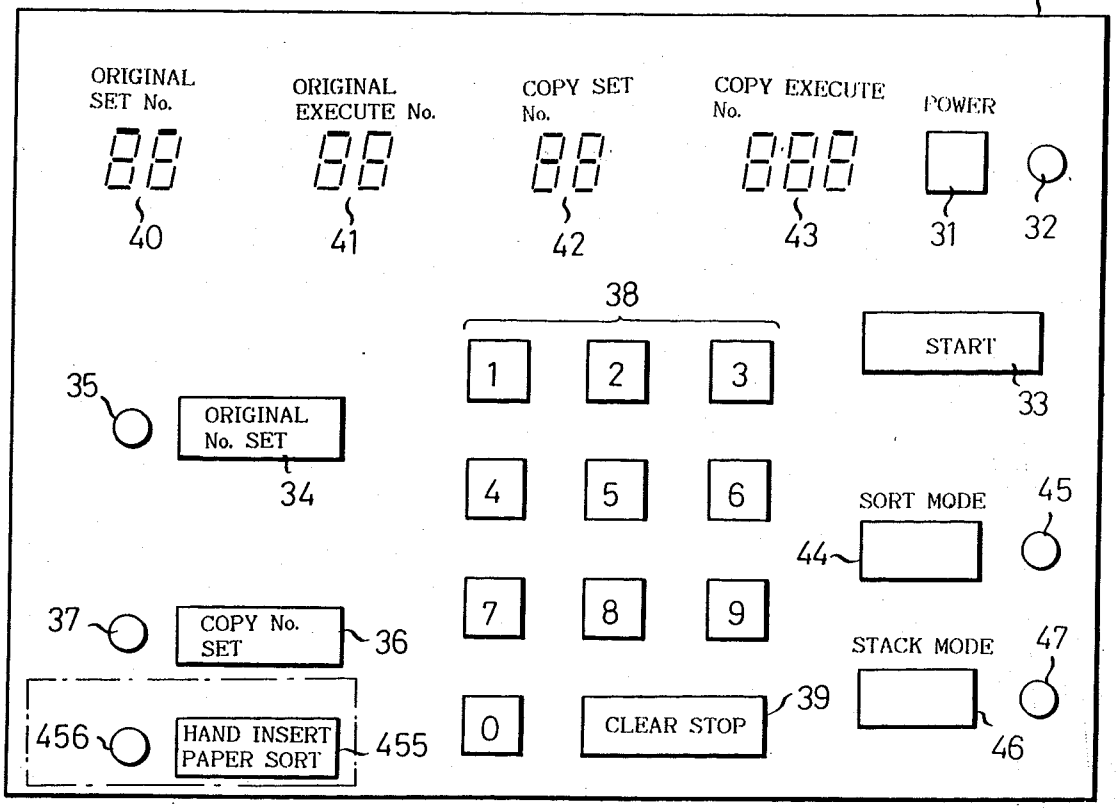
FIG. 4 is a plan view of a typical operation indicating panel.

FIG. 4 shows an operation indication panel 30 disposed on top of the outer casing 2*a* covering the aforesaid electrostatic copying machine 2. The operation is as follows:

On the operation indication panel 30, there is an array of functional parts as keys and indicators as follows:

a power key 31 turning power ON or OFF, a power indicator 32 giving visual presentations of the power ON or OFF, a START key 33 initiating copying operation, an original No. set key for setting original No., an original No. set indicator 35 showing the original No. set key ON or NOT, a copy No. set key 36 for setting copy No., a copy No. set indicator 37 showing the copy No. set key ON or NOT, a set of ten keys 38 for inputting original No. or copy No., a CLEAR STOP key 39 for clearing Nos. inputted by the ten keys 38 as well as for stopping copying operation, an original set No. indicator 40 showing original set No., an original execute No. indicator 41 showing the No. of original sheets having been copied, a copy set No. indicator 42 giving the No. of sets to be copied, a copy execute No. indicator 43 showing the No. of copied sheets P, a sort mode key 44 for setting sort mode, a sort mode indicator 45 showing if sort mode has been SET or NOT, a stack mode key 46 for setting stack mode, and a stack mode indicator 47 showing if stack mode has been SET or NOT.

When any of the ten keys 38 are typed in after the aforesaid original No. set key 34 is turned ON, the No. of original sets to be copied is inputted, and when ten keys 38 are typed in after the aforesaid copy No. set key 36 is turned ON, the No. of recording sets to be copied is inputted. The aforesaid "sort mode" refers to a mode where recorded sheets P are sorted on every bin 9 in turn sheet by sheet. The aforesaid "stack mode" refers to the other mode where recorded sheets P are stacked, first on a 1st bin to its full capacity, and second on a 2nd bin also to its full capacity and so on in turn.

Figure 5:
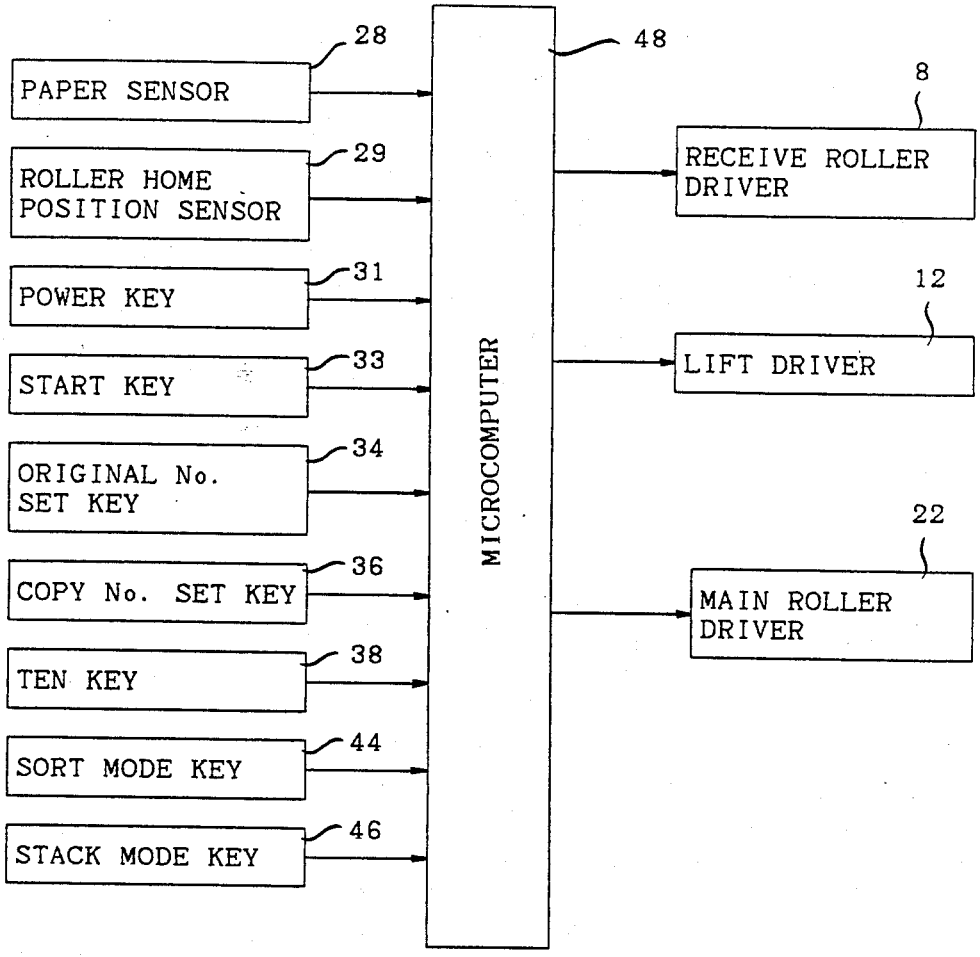
FIG. 5 is a block diagram of a control operation for the aforesaid sheet discharge.

FIG. 5 shows a control for the aforesaid sorter 1. The operation is as follows:

Such information as from the aforesaid sheet sensor 28, the 33, the original No. set key 34, the copy No. set key 36, the ten keys 33, the sort mode key 44 and the stack mode key 46 is stored in an input port of a microcomputer 48.

Stored in a RAM in the aforesaid microcomputer 48 are data from an original No. set counter, a copy set No. counter, a total copy set No. counter, a discharged sheet No. counter, a sort mode flag, a target bin No. counter and a lift flag. The aforesaid sort mode flag becomes "1" when the sort mode key 44 is turned ON, and becomes "0" when the stack mode key is turned ON. The aforesaid target bin No. counter counts the number of target bins being used in sort mode, and equals the value of the copy set No. counter. The aforesaid lift flag becomes "1" when the movable member 10 is lowered, and becomes "0" when raised.

To an output port in the aforesaid computer 48 are connected the receive roller driver 8, the lift driver 12, the main roller driver 22 and so on.

Figure 6A:
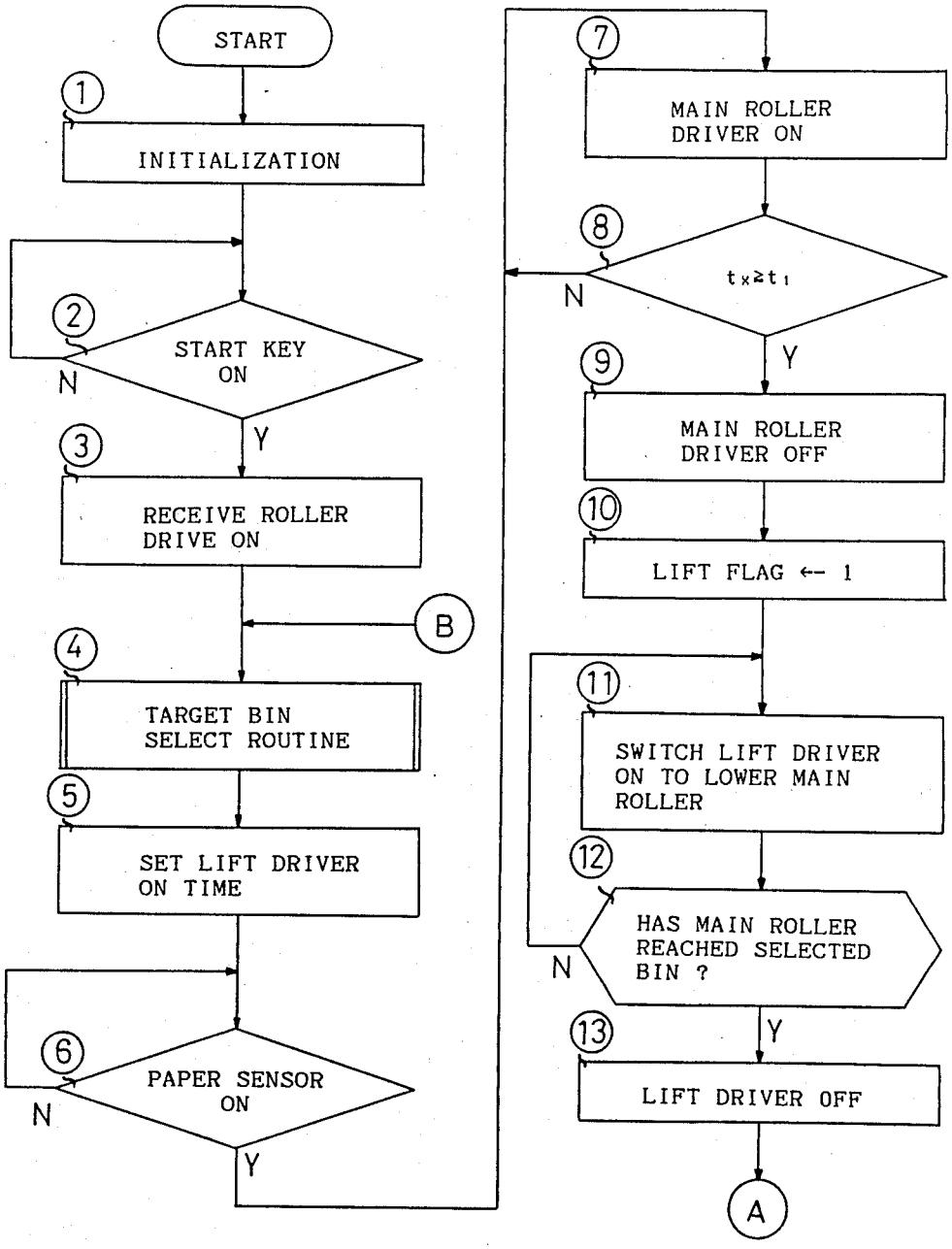
FIGS. 6 and 7 are control flow charts in use in the aforesaid control.
Figure 6B:
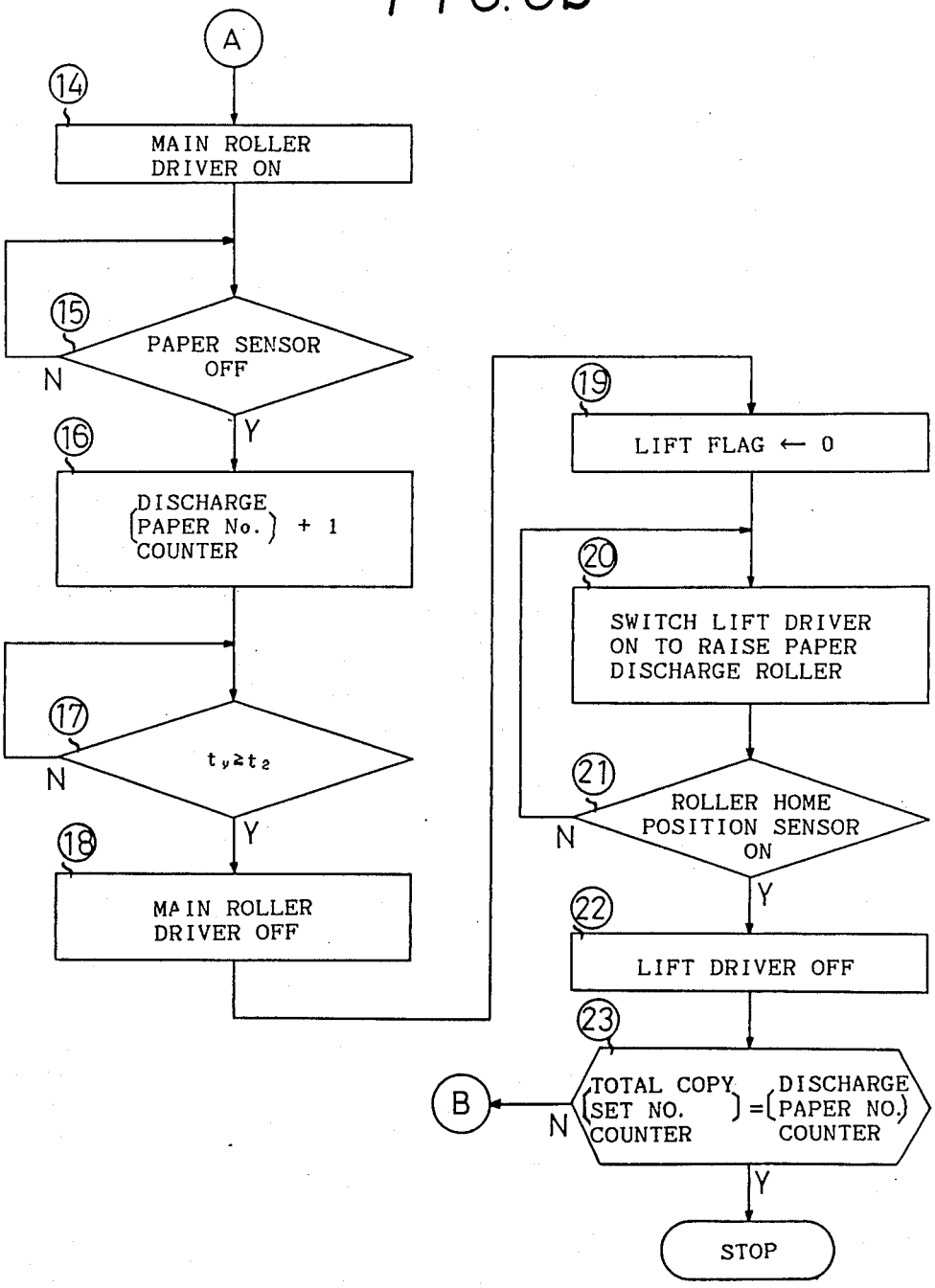
Figure 7:
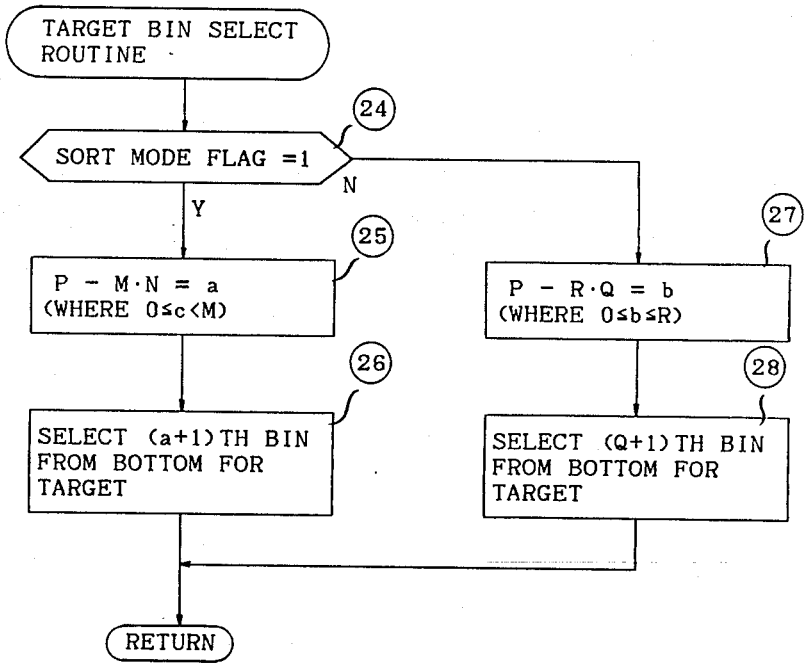

FIGS. 6*a*, 6*b* and 7 illustrate how the aforesaid sorter 1 is operated. The flow charts in these figures show one example when a home position, where the main rollers 21 receive recorded sheets P, happens to be above the highest bin 9*a*.

When a signal of the aforesaid power key ON is sent to the microcomputer 48, operation is executed according to a program (shown in the flow charts in FIGS. 6*a* to 7) incorporated in ROM in the microcomputer 48. FIGS. 6*a* and 6*b* show a main routine of the flow, and FIG. 7 a subroutine.

First, Step 1 initializes the sorter system to clear data in the RAM and I/O ports in the microcomputer 48.

Second, Step 2 checks if the START key 33 is turned ON or NOT. If the Step 2 determines that the START key 33 has been turned ON, Step 3 turns ON the receive roller driver 8, and then through Step 4, a target bin select routine, Step 5 sets ON-time of the lift driver 12 in accordance with a target bin 9 selected by the target bin select routine.

Then, Step 6 checks if the sheet sensor 28 has been turned ON or NOT. If Step 6 determines that the sheet sensor 28 has been ON, i.e., the sheet sensor has detected a leading edge of recorded sheet P, Step 7 turns ON the main roller driver 22, and then Step 8 checks if $t_x$ is larger than or equal to $t_l$ or not. Here, $t_x$ is an elapse time from the instant when the sheet sensor 28 became ON, and $t_l$ a time, from the instant when the sheet sensor 28 became ON (when the main roller driver 22 was turned ON), required for the main rollers 21 and the 1st and 2nd followers 15 and 25 to pinch the leading edge of recorded sheet P.

If the aforesaid Step 8 determines that $t_x$ is larger than or equal to $t_1$, Step 9 turns OFF the main roller driver 22, Step 10 makes the lift flag "1", Step 11 turns ON the lift driver 12 to lower (move forward) the main rollers 21. Next, Step 12 checks if the main rollers 21 have reached or not a bin 9 selected by the Step 4, target bin select routine, in other words, checks if the lift driver 12 is kept ON or not for the ON-time of the lift driver 12 set in the Step 5.

If the Step 12 determines that the main rollers do not have reached the selected bin 9, the flow is returned to the Step 11 to keep ON the lift driver 12. If the Step 12 determines that the main rollers 21 have reached the selected bin 9, Step 13 turns OFF the lift driver 12, and after Step 14 turns ON the main roller driver 22, Step 15 checks if the sheet sensor 28 is OFF or NOT.

If the Step 15 determines that the sheet sensor 28 is OFF, or the sheet sensor 28 detects the trailing edge of recorded sheet P, Step 16 adds 1 to a value of recorded sheet discharge No. counter and then Step 17 checks if $t_y$ is larger than or equal to $t_2$ or not, where $t_y$ is an elapse time from the instant when the Step 15 determined that the sheet sensor 28 was OFF, and $t_2$ is a time, from the instant when the Step 15 determined that the sheet sensor 28 was OFF, required for recorded sheet P discharged by the main rollers 21 to get out of the main rollers 21.

If the aforesaid Step 17 determines that $t_2$ is larger than or equal to $t_2$, Step 18 turns OFF the main roller drive 22. Step 19 makes the lift flag "0", and Step 20 turns ON the lift driver 12 to raise (move backward) the main rollers 21. Next, Step 21 checks if the roller home position sensor 29 is turned ON or NOT. If Step 21 determines that the roller home position sensor 29 is not turned ON, the flow is returned to the Step 20 to keep ON the lift driver.

If the aforesaid Step 21 determines that the roller home position sensor 29 is ON, Step 22 turns OFF the lift driver 12 to place the main rollers 21 at the home position, and then Step 23 checks if the total copy set No. counter equals the discharged sheet No. counter or not. If the Step 23 determines that the total copy set No. counter does not equal the discharged sheet No. counter, the flow is returned to the Step 4. When the Step 23 determines that the total copy set No. counter equals the discharged sheet No. counter, a complete cycle of this operation is over.

FIG. 7 shows the detailed flow chart of the target bin select routine, the Step 4 in FIG. 6*a*. The operation is as follows:

First, Step 24 checks if the sort mode flag equals "1" or not. If the Step 24 determines the sort mode flag=1, that is, the present mode is "sort mode", Step 25 finds N and a to satisfy $P\text{-}MN=a$ (where $0 \leqq a < M$), where the aforesaid P is a value of the discharged sheet No. counter, M is a value of the stacked bin No. counter, and N and a are zero or positive integer. Using the a solved in the Step 25, Step 26 selects a (a+1)th bin 9 from bottom as a target bin 9 and returns the flow back to the main routine.

If the Step 24 determines the sort mode flag is not "1", that is, the present mode is "stack mode", Step 27 finds Q and b to satisfy $P - RQ=b$ (where $0 \leqq b < R$), where the aforesaid R is a maximum No. of recorded sheets P to be stacked on a bin 9, and Q and b are zero or positive integer. Using the Q solved in the Step 27, Step 28 selects a (Q+1)th bin 9 from bottom as a target bin 9 and returns the flow back to the main routine.

The home position of the aforesaid main rollers 21 would vary in accordance with a position of a paper discharge port 3 in an electrostatic copying machine 2. If the paper discharge port 3 is provided at the bottom of the electrostatic copying machine 2, a home position of the main rollers 21 can be set below the lowest bin 9*b* among a plurality of bins 9 to meet the position of the paper discharge port 3. The positions of the paper discharge port may ran the gamut as such from top to bottom, but since there is no need to change the movable member 10 and the configuration associated therewith, this sheet discharge device can be readily applied to various types of electrostatic copying machines.

In the above embodiment, the main rollers 21, the 1st follower 15 and the 2nd follower 25 have such three functions as described below:

(1) as a sheet pinch means where recorded sheets P discharged from an electrostatic copying machine 2 are momentarily held, (2) as a sheet discharge means where the recorded sheets P pinched momentarily as such are again transferred to be discharged to bins 9, and (3) a sheet carry direction changing means wherer a sheet carry direction of recorded sheets being sent is changed through a sheet carry path 50 formed by the sheet guide member 11 (FIG. 1) (in the embodiment changed 180 degrees for the sheet carry direction in the sheet carry path 50).

However, instead of providing them all together with the three functions, respective members having the respective three functions may be independently provided on the movable member 10.

Figure 8:
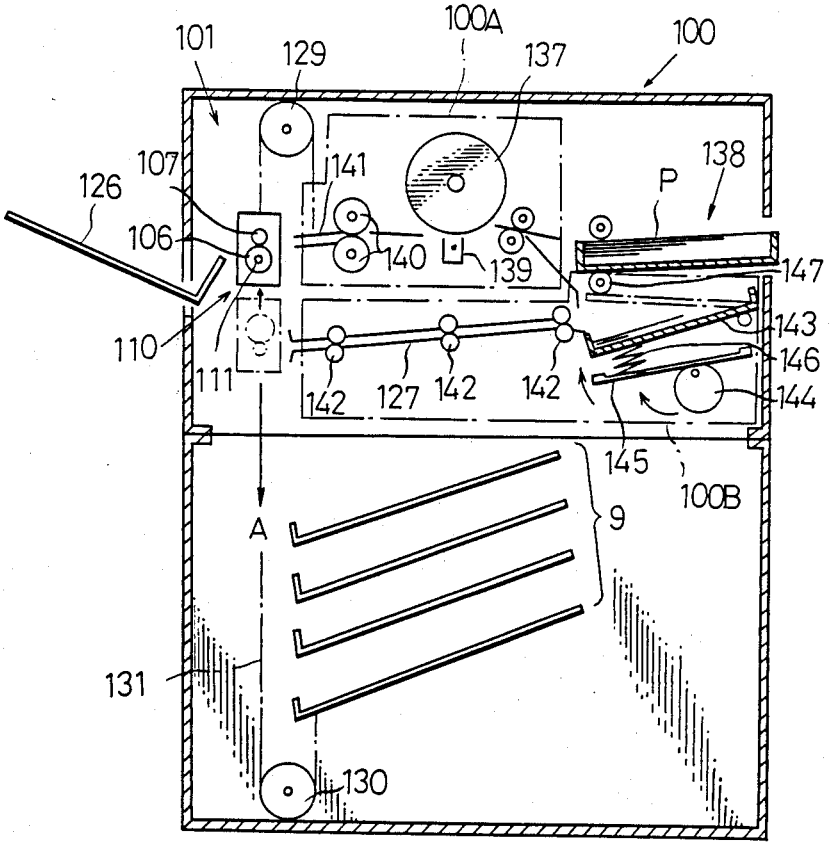
FIG. 8 is a side sectional view of a system using the second embodiment of a sheet discharge device according to the invention.

FIG. 8 shows another embodiment. In this embodiment, a sheet handling device 100 comprises an image copying means 100A and a reverse carrier 100B. The image copying means 100A discharges a sheet of recorded paper P out of a paper discharge path 141 after copying the image on one side of the recording paper P fed from a paper feed portion 138. The reverse carrier 100B takes in the recorded paper P, discharged from the paper discharge path 141, through a reverse path 127 and feeds it again to the image copying means 100A by means of a paper feed roller 147.

In this embodiment, a sheet discharge device 101 comprises a movable member 110 vertically travelled by belts 131 looped over upper pulleys 129 and lower pulleys 130, a paper discharge tray 126 provided on the left of the paper discharge path 141 in the image copying means 100A, and a plurality of bins 9 provided in a lower portion of the sheet handling device 100. The movable member 110 comprises two pairs of rollers, i.e. first rollers 106 and second rollers 107, which are in pressure contact with each other.

Figure 9:
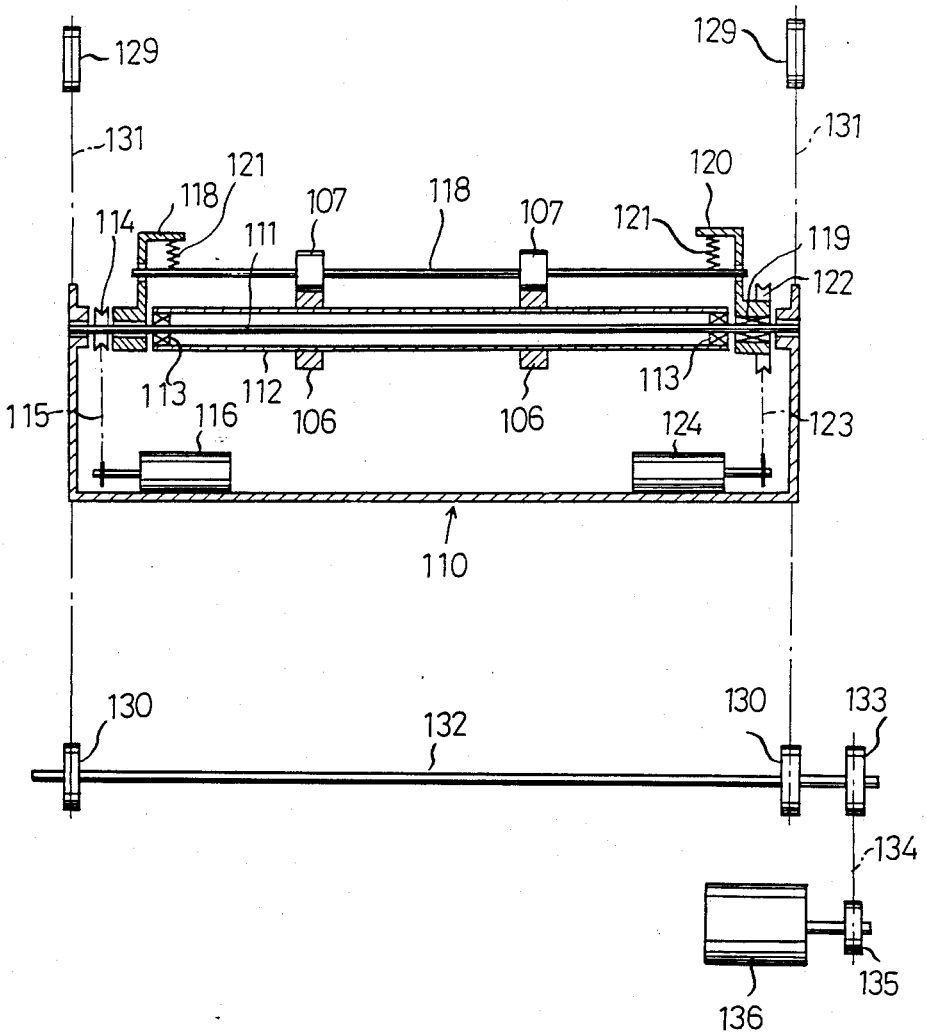
FIG. 9 is a front sectional view of the aforesaid sheet discharge device.
Figure 10:
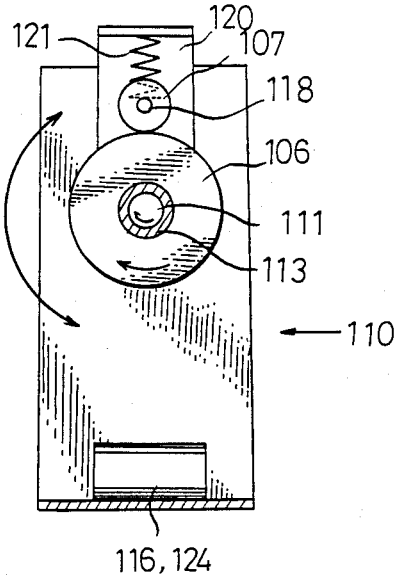
FIG. 10 is 11 is a sectional view of a movable member in use for the discharge device.

The first rollers 106 are, as shown in FIG. 9, formed on the outer circumference of a cylindrical member 112 as a one-piece a assembly. The cylindrical member 112 is mounted on a first shaft 111 through one-way clutches 113. The first shaft 111 is supported on the upper portion of the movable member 110 so as to allow free rotation but no axial movement. A pulley 114, fixed on the left end of the first shaft 111, is connected to the output shaft of a sheet carry motor 116 by a belt 115. The sheet carry motor 116, fixed on the bottom of the movable member 110, rotates the first shaft 111 clockwise in FIGS. 8 and 10. With the first shaft 111 rotating clockwise as described above, the one-way clutches 113 transmits the rotation to the first rollers 106 to rotate the first rollers 106 in the clockwise direction ( in the sheet carry direction). When the first shaft 111 is stalled, the one-way clutches 113 keeps the first rollers 106 from rotating counterclockwise.

The second rollers 107 in pressure contact with the first rollers 106 are, as shown in FIG. 9, mounted on a second shaft 118 so as to allow free rotation but no axial movement. The second shaft 118 is supported by a first arm 118 installed at the left end of the first shaft 111 so as to freely rotate about the first shaft 111 and a second arm 120 installed at the right end of the first shaft 111 through a one-way clutch 119. Springs 121 and 121 depress down the second rollers 107 against the first rollers 106. As the first rollers 106 rotate in the clockwise direction (in the sheet carry direction) shown in FIG. 10 by the sheet carry motor 116, the second rollers 107 rotate in the counterclockwise direction (also in the sheet carry direction).

Figure 11:
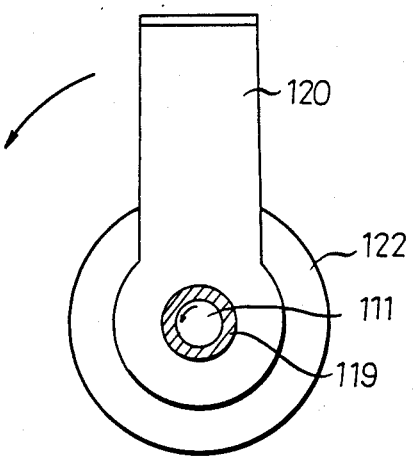
FIG. 11 sectional view of the main part of the aforesaid movable

In FIG. 9, a pulley 122, fixed on the second arm 120, is connected to the output shaft of a carry path change motor 124 by a belt 123. The carry path change motor 124 rotates the second arm 120 counterclockwise in FIGS. 8 and 11. With the second arm 120 rotating counterclockwise as described above, the one-way clutch 119 transmits the rotation to the first shaft 111 to rotate the first shaft 111 counterclockwise. A counterclockwise rotation of the first shaft 111 causes a simultaneous counterclockwise rotation (in the sheet carry direction) of the first rollers 106 (FIG. 8) by the same degrees. The installation of the one-way clutch 119 keeps the second arm 120 stopping when the first shaft 111 is rotated clockwise.

As shown in FIGS. 8 and 9, the movable member 110 supporting the first and second rollers 106 and 107 is supported by two belts 131 respectively looped over two respective pairs of pulleys 129 and 130. The two lower pulleys 130 are, as shown in FIG. 9, fixed on a shaft 132 which is rotated by a lift motor 136 via a pulley 133, a belt 131 and a pulley 135. Rotation of the shaft 132 causes the belts 131 to vertically move, resulting in the vertical travel of the movable member 110 hung on the belts 131.

In the image copying means 100A in FIG. 8, a toner image (a visible image) according to the original image is formed on the surface of a photosensitive member 137 using the well known copying process. The toner image is laid over a sheet of paper, e.g. the recording paper P, fed from the paper feed portion 138. Under this condition, the toner image is subjected to electric discharge from a transfer charger 139 to be transferred on the recording paper. After that, the recording paper is separated from the photosensitive member 137 and subjected to fixing conducted by a pair of fix rollers 140.

With a normal paper discharge mode wherein the recorded paper, which has been a copy product being fixed, is discharged directly on the paper discharge tray 126, the movable member 110 supporting the first rollers 106, etc. are positioned between a paper discharge path 141 and the paper discharge tray 126 as shown in full lines. Accordingly, the recorded paper fed from the pair of fit rollers 140 is discharged directly into the paper discharge tray 126 by the first rollers 105 and the second rollers 107.

Figure 12:
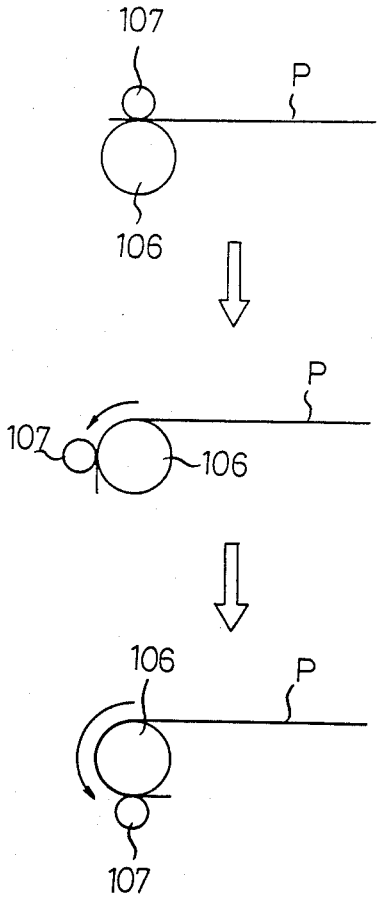

When another original image is to be copied on the other surface of a paper already fixed on the surface, the recording paper is not discharged on the paper discharge tray 126 but these rollers come to a stop with the paper pinched between the first and second rollers 106 and 107. After that, the second rollers 107 are epicycled around the first rollers 106 until reaching thereunder, as shown in FIG. 12, by actuating the carry path change motor 124 in FIG. 9. After completion of the epicycle travel of the second rollers 107, the belt lift motor 136 in FIG. 9 starts to move the movable member 110 down to a position facing the reverse path 127, as shown by a chain line FIG. 8, and then the movable member 110 comes to a halt. The first and second rollers 106 and 107 again start rotation to feed the recording paper P holding the fixed image on the upside-down surface thereof into the reverse path 127. The recording paper fed into the reverse path 127 is carried into a reverse tray 143 by carry rollers 142. The reverse tray 143 is timely rotated upward as shown in a chain line by an eccentric cam 144, a rocking lever 145 and a spring 146, so that the aforesaid recording paper placed in the reverse tray 143 comes into contact with a paper feed roller 147. Rotation of the paper feed roller 147 allows the recording paper holding the image on the lower surface thereof to be fed again to the photosensitive member 137, and the aforesaid transfer and fixing are carried out on the other surface of the recording paper, thus completing image copy cycle on both sides of surfaces of paper.

In the meantime the movable member 110 is lifted up to the original position shown by a full line in FIG. 8 by the belts 131, so that the recorded paper having completed copying on the other surface thereof too can be finally discharged on the paper discharge tray 126 by the first and second rollers 106 and 107.

In the case where a recorded paper on which copying has been conducted by the image copying means 100A is not to be discharged on the paper discharge tray 126 but to be sorted into a plurality of sorter bins 9, the aforesaid first and second rollers 106 and 107 are brought to a halt, when a leading edge of the recorded paper is held between the rollers 106 and 107 placed on a position shown by a full line in FIG. 8. Then the second rollers 107 epicyclically travel as shown in FIG. 12 and further the belt lift motor 136 is actuated to lower the movable member 110 until it comes in front of the desired sorter bin 9 as shown by Arrow A in FIG. 8. The recorded paper can be stacked in the desired sorter bin 9 by again rotating the first and second rollers 106 and 107. Sorting is conducted in such a manner as the lifting of the movable member 110 and the pinching and carrying of a recorded paper by the first and second rollers 106 and 107 are repeated every time the recorded paper is discharged from the pair of the fix rollers 140.

However arbitrarily the positional relation of a paper discharge path 141 on which a recorded paper is discharged from the image copying means 100A to a paper discharge tray 126 and sorter bins 9 may change, the embodiment can also cope with any change of the positional relation only by an extremely simple operation, i.e. just by changing the home position of the movable member 110.

Additionally, in the embodiment, the first and second rollers 106 and 107 serve as a sheet pincher, sheet discharger and sheet carry direction changer as well.

Figure 13:
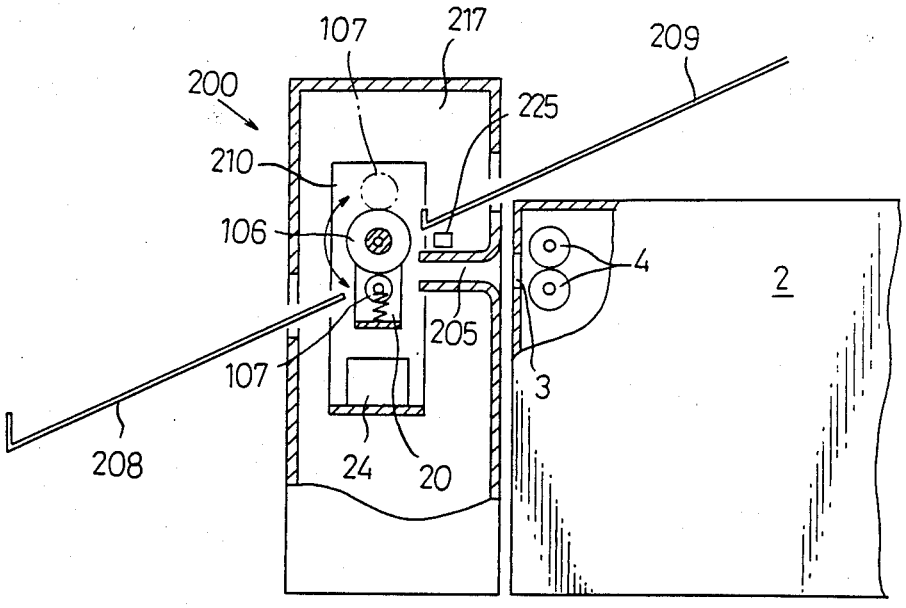
FIG. 13 is a side sectional view of an embodiment of a sheet discharge device related to the invention.

Another sheet discharge device 200 as shown in FIG. 13, which does not belong to an embodiment of the invention, can be constructed using the aforesaid first rollers 106 and second rollers 107 epicyclically travelling around the first rollers 106.

In FIG. 13, a sheet discharge device 200 comprises a sheet receive port 205 disposed at the downstream of a pair of paper discharge rollers 4 and a paper discharge port 3 in a copying machine 2 (at the left side of the figure), first rollers 106 disposed at the downstream of the sheet receive port 205, second rollers 107 disposed opposite to the first rollers 106 (in pressure contact therewith with the embodiment), a first paper discharge tray 208 installed at the left side of these rollers, and a second tray 209 installed upward at the right of the first rollers 106. A drive mechanism for the first and second rollers 106 and 107 is similar to that in the aforesaid embodiment illustrated in FIG. 9. The difference is that a casing 210 as a member corresponding to the movable member 110 in the previous embodiment is immovably fixed to an outer casing 217 of the sheet discharge device 200.

When continuous copying is performed by the copying machine 2 and resulting copy products are continuously discharged on the first paper discharge tray 208, the first and second rollers 106 and 107 are in pressure contact with each other as shown in FIG. 13. The sheet carry motor 116 in FIG. 9 is driven by order of a controller (not shown) controlling the copying process conducted by the copying machine 2. As a result, as the first rollers 106 are rotated clockwise (in the sheet carry direction), the second rollers 107 are driven for rotation. The pair of paper discharge rollers 4 feed a recorded sheet paper into the pressure,-contact portion between the first and second rollers 106 and 107(i.e. the nip portion) through the paper discharge port 3 and the sheet receive port 205. Rotation of these rollers in the sheet carry direction as described above permits sheets to be successively discharged on the first paper discharge tray 208 and stacked thereon.

When the so-called interrupt-copying (i.e. copy a sheet or several sheets of original other than sheets of paper currently under continuous-copying operation) is to be carried out while discharging the continuously copied sheets, it is desirable that recorded sheets, by interrupt-copying and continuous-copying be discharged on separate trays. With this device, recorded sheets by interrupt-copying would be discharged on the second paper discharge tray 209 other than the first paper discharge tray 208 according to the following operation:

Before starting this operation, a sheet detect sensor 225 is preset at the sheet receive port 205. The sheet detect sensor 225 detects a leading edge of a recorded paper passing through the sheet receive port 205 to send a sheet detect signal to the aforesaid copying process controller.

When interrupt sheets are to be discharged on the second paper discharge tray 209, the operator's pressing an interrupt command button disposed on the copying machine 2 will set up the interrupt mode in the aforesaid copying process controller. In this mode, the copying process itself is similar to that in the normal continuous paper discharge mode, and, after all, recorded sheets by interrupt-copying are discharged similarly from the pair of paper discharge rollers 4. On detecting a leading edge of recorded paper passing through the sheet receive port 205 in the sheet discharge device 200, the sensor 225 sends the sheet detect signal to the copying process controller, which in turn actuates the sheet carry motor 116 (FIG. 9),to rotate the first rollers 106 for a predetermined short period of time. The short time period of rotation first rollers 106 allows the sheet having passed through the sheet receive port 205 to be held between the first and second rollers 106 and 107 at the leading edge thereof, and then the first rollers 106 comes to a stop.

Figure 14:
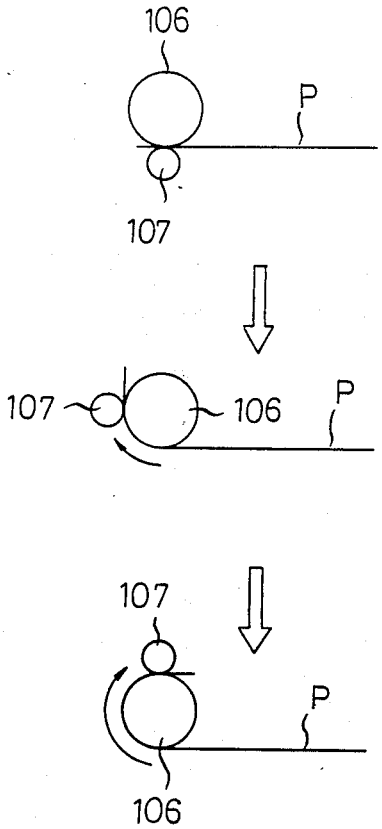
FIGS. 12 and 14 are schematic diagrams showing a change (i.e. reverse) sequence of a sheet carry direction for use in the aforesaid movable member.

After completion of the above operation, the copying process controller actuates a carry path change motor 124 instead of the sheet carry motor 116 to turn a second arm 120 upward by 180 degrees from the position shown by a full line in FIG. 13 (clockwise rotation). In this manner, the second rollers 107 epicyclically travel around the first rollers 106 as shown in FIG. 14 while pinching the leading edge of the sheet, until they reach the top of the first rollers 106, and the nip portion between the first and second rollers 106 and 107 faces the port of the second paper discharge tray 209 as shown in FIG. 13.

After that, the sheet carry motor 116 (FIG. 9) again starts to allow the recorded paper to be carried forward, i.e. toward the second paper discharge tray 209 and discharged thereon. Then the second arm is turned counterclockwise in FIG. 13 to travel the second rollers 107 again to the lowest position shown in FIG. 13. With the second rollers again reaching the lowest position, the continuous-copying which has been interrupted for a while is restarted, permitting the previous continuous discharge of recorded sheets on the first paper discharge tray 208.

Figure 15:
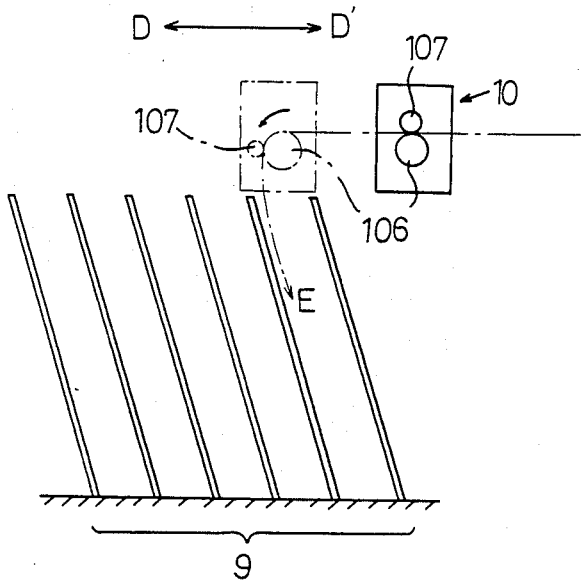
FIG. 15 is a schematic drawing showing the third embodiment according to the invention.

In the embodiments shown in FIGS. 1 and 8, the sheet carry direction changers, such as the main rollers 21 and the followers 15 and 25 (FIG. 1) as well as the first and second rollers 106 and 107 (FIG. 8), change a recorded paper carry direction by 180 degrees whereby recorded sheets are placed upside-down. The degree of angle required in changing the recorded paper carry direction using a sheet carry direction changer is not limited to 180 degrees, but may be arbitrarily set according to a travel direction of the movable member 10 or 110 and the location of sheet trays. For example with a movable member 10 horizontally travelling as shown by Arrow DD' in FIG. 15, and with sorter bins 9 as sheet trays essentially vertically arranged, the sheet carry direction is changed by approximately 90 degrees as shown by Arrow E. In this case, in which the first and second rollers 106 and 107 in FIG. 8 are also used as a sheet carry direction changer, the second rollers 107 epicyclically travel around the first rollers 106 by nearly 90 degrees (i.e. counterclockwise).

Figure 16:
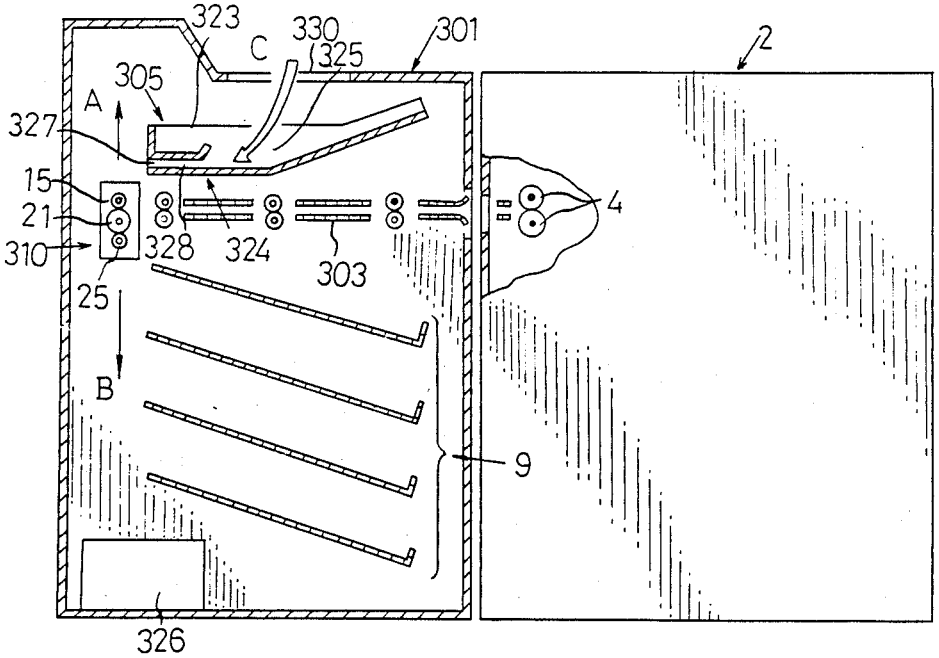
FIG. 16 is a side sectional view of a system using the fourth embodiment of a sheet discharge device according to the invention.

FIG. 16 shows another embodiment according to the invention. A sheet discharge device 301 comprises a sheet carry path 303, a plurality of sorter bins 9 (e.g., four pieces), a handling unit 305 wherein a sheet hand inserter 324 and a paper discharge tray 323 are integrally formed, and a movable member 310. Recorded sheets discharged from a pair of paper discharge rollers 4 in the copying machine 2 are discharged on the sorter bins 9 as well as on the paper discharge tray 323 in the sheet handling unit 305.

Figure 17:
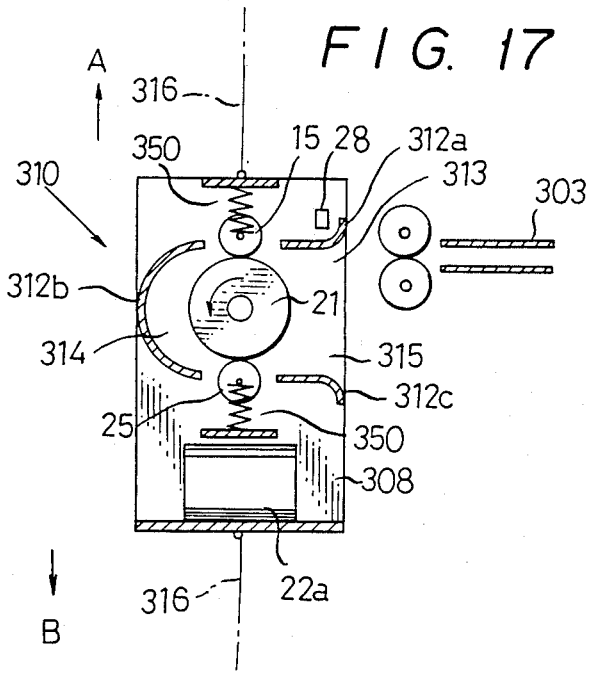
FIG. 17 is a side sectional view of a movable use for the sheet device shown in FIG. 16.
Figure 18:
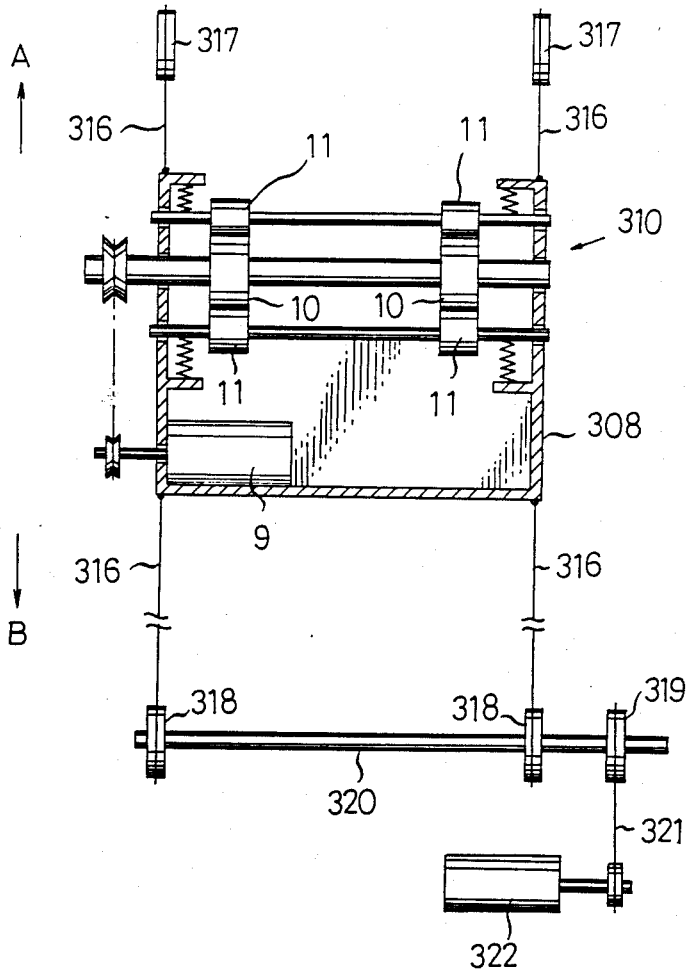
FIG. 18 is a front sectional view of the aforesaid movable member.

The movable member 310 comprises, as shown in the side view thereof in FIG. 17 and the front view in FIG. 18, a support casing 308, and three guide plates **312*a*, 312*b* and 312*c* securely mounted thereon. These guide plates form a sheet receive port 313, a reverse carry path 314 and a sheet discharge port 315. The main rollers 21 and the followers 15 and 25 are supported by the support casing 308. The main rollers 21 are rotated counterclockwise in FIG. 17 by the main roller drive motor 22*a*. The followers 15 and 25 are respectively depressed down/up against the main rollers 21, and forced by two springs 350. The support casing 308 is, as shown in FIG. 18, provided with wires 316, two upper pulleys 317, and two lower pulleys 318 to which the wires 316 are connected, and a lift driver consisting of a shaft 320 supporting the lower pulleys 318 and a transmission pulley 319 and a motor 322 connected to the pulley 319 by a wire 321 to lift the support casing 308**.

The motor 322 is so designed as to revolve reversibly according to an order from a controller 326 (with built-in microcomputer) disposed on the bottom of the sheet discharge device 301 in FIG. 16. The reversible rotation of the motor 322 allows the movable member 310 to vertically travel in either directions as shown by Arrows A and B.

A sheet detect sensor 28, disposed on the sheet receive port 313, detects a leading edge of sheet fed into the sheet receive port 313 and sends a sheet detect signal to the controller 326. The controller 326 having received the sheet detect signal starts to rotate the main rollers 21 for a fixed short time and thereafter stops their rotation. The motion of the main rollers 21, i.e. the rotation and stop thereof, allows the sheet having passed through the sheet receive port 313 to be held between the main rollers and the followers 15 and 25. For pinching the sheet, only the followers 15 or both the followers 15 and 25 may be used.

Figure 19:
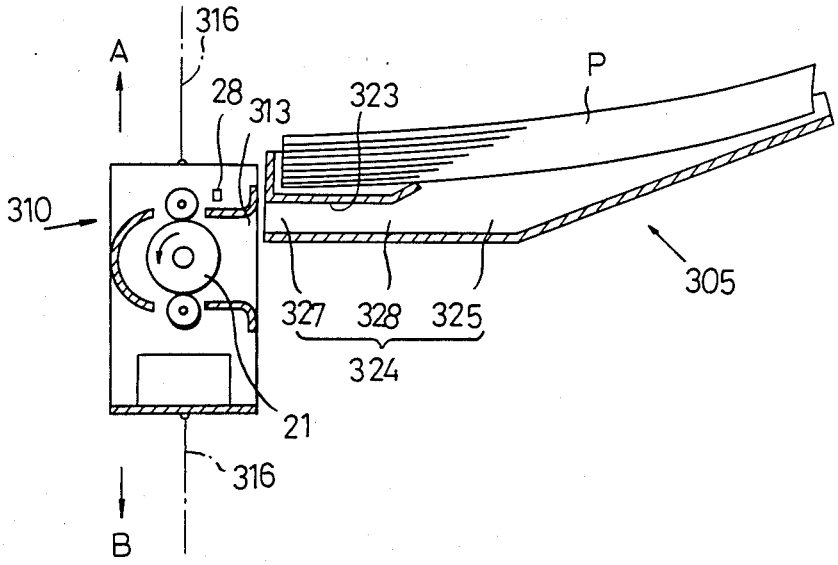
FIG. 19 is a sectional view of the main parts of the sheet discharge device showing in FIG. 16.

In FIGS. 16 and 19, the sheet handling unit 305 comprises a paper discharge tray 323 for receiving recorded sheets discharged and a sheet hand inserter 324 integrally formed thereunder for hand inserting recording sheets. The sheet hand inserter 324 consists of an opening 325 formed under the bottom of the paper discharge tray 323, another opening 327 facing to a travel path of the movable member 310, and a sheet path 328 connecting the openings 325 and 327.

The controller 326 in FIG. 16 incorporates a microcomputer. A program stored in a ROM in the microcomputer performs three different sheet carry modes; sort mode, special sheet carry mode and hand insert mode. The following is the individual description of the three modes.

SORT mode:

In this mode, recorded sheets discharged from a copying machine 2 are sorted into desirable sorter bins 9.

As shown in FIG. 17, the movable member 310 is so positioned that the sheet receive port 313 can communicate with the sheet carry path 303. Which allows recorded paper carried through the sheet carry path 303 from the copying machine 2 to be fed into the movable member 310 through the sheet receive port 313. And the recorded sheet comes to a stop after being held between the main rollers 21 and the followers 15 as described above.

Then the wires 316 (FIG. 18) are pulled downward to properly lower the movable member 310. When the sheet discharge port 315 reaches in front of a target bin 9, the movable member 310 stops its movement. The main rollers 21 again starts rotation to feed out the recorded sheet from the sheet discharge port 315, thus stacking the sheet in the aforesaid target bin 9.

Thereafter the movable member 310 is again lifted by the wires 316 up to the position in FIG. 16 to wait for a following recorded sheet coming. The same operational sequence as indicated above is repeated so as to proceed with the following recorded sheets to be sorted into individual target bins 9.

HAND INSERT mode

When the aforesaid SORT mode is being performed, it may be sometimes desirable that one or more sheets of separate paper from the recorded sheets of paper being currently sorted are inserted in an interrupted fashion inserted into the respective bins 9. This mode is used in such a case.

Sorting operation for this mode is conducted in the same way as that in the above SORT mode. When interrupt-insertion is required, a command key properly located is pushed to signal an order to that effect to the controller 326. Receiving the signal, the controller 326 actuates the movable member 310 upward to the higher position than that in FIG. 16 to set it so that the sheet receive port 313 can communicate with the opening 327 in the sheet inserter 324 as shown in FIG. 19.

At this condition, as shown by Arrow C in FIG. 16, an interrupt sheet is manually inserted into the sheet receive port 313 through the opening 330 on top of the sheet discharge device 301, and the opening 325, the sheet path 328 and the opening 327 in the sheet inserter 324. Then, in a similar way to the aforesaid SORT mode, the interrupt sheet is pinched by the main rollers 21, etc., and the movable member 310 is vertically moved by the wires 316, etc., which allows the interrupt sheets manually inserted sheet by sheet as shown by Arrow C to be sorted into the sorter bins 9. In this manner, interrupt sheets other than recorded sheets being sorted are inserted into the respective bins 9.

SPECIAL SHEET CARRY mode

This mode is used when one or several sheets of recorded paper discharged from the copying machine 2 are required to be discharged in a place other than the bins 9 during the aforesaid SORT mode. To meet this requirement, in this embodiment special sheets to be discharged in other place are discharged in the paper discharge tray 323 in the sheet handling unit 305.

When the SPECIAL SHEET CARRY mode is directed to the controller 326 by key operation, the special sheet is pinched by the main rollers 21 and the followers 15 when they are located as shown in FIG. 16, and then the movable member 310 is lifted upward (in the direction A) to set the sheet discharge port 315 (FIG. 17) to a slightly higher position than the paper discharge tray 323.

Then the main rollers 21 are again rotated to discharge the special sheet in the paper discharge tray 323. With more than one special sheet, the aforesaid operation is repeated between the sheet carry path 303 and the paper discharge tray 323 to stack special sheets P on the paper discharge tray 323 as shown in FIG. 19.

While, in the aforesaid embodiment in FIG. 17, the main rollers 21 are rotated counterclockwise with the sheet receive port 313 disposed higher than the sheet discharge port 315, the main rollers 21 may be rotated clockwise provided that a port corresponding to Numeral 315 is adapted for a sheet receiving port and another port corresponding to Numeral 313 for a sheet discharge port. Furthermore, the main rollers 21 can be so designed as to rotate clockwise/counterclockwise to alternatively use the sheet ports corresponding to Numerals 313 and 315 for a sheet receive port a sheet discharge port.

Additionally, the sheet hand inserter 324 and the paper discharge tray 323 for the special sheet are formed as a one-piece member in aforesaid embodiment, but only the sheet hand inserter can be provided for a sheet carry device which has no SPECIAL SHEET CARRY mode.

Figure 20:
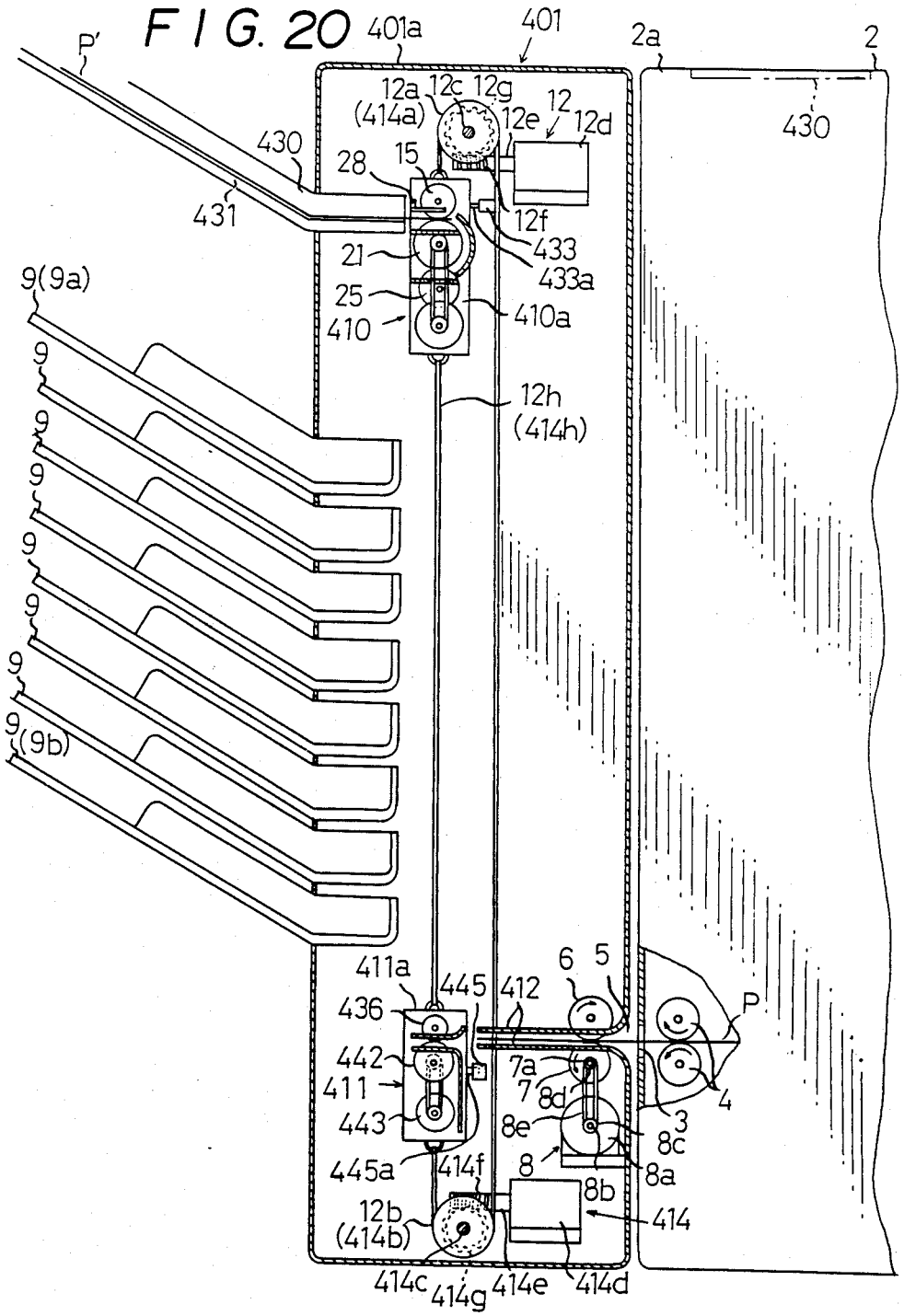
FIG. 20 is a side sectional view of the fifth embodiment of a sheet discharge device according to the invention.

FIG. 20 shows another embodiment of a sheet discharge device according to the invention. An electrostatic copying machine 2 is disposed adjacent to an outer casing 401*a* of a sheet discharge device 401. A casing 2*a* of the electrostatic copying machine 2 is also provided with a sheet discharge port 3 and a pair of paper discharge rollers 4. Within the outer casing 401*a* of the sheet discharge device 401, a pair of receiving rollers 6 and 7 are disposed in the vicinity of a paper receive port 5 opposite to the paper discharge port 3. The receive roller 7 in pressure contact with the receive roller 6 is rotated by a receive roller driver 8. The receive roller driver consists of a motor 8*a* fixed inside the casing 401*a*, a pulley 8*c* fixed on a drive shaft 8*b* of the motor 8*a*, a pulley 8*d* fixed on a shaft 7*a* of the receive roller 7 and a belt 8*e* looped over the pulleys 8*c* and 8*d*.

On a side to which the aforesaid receive rollers 6 and 7 feed recorded paper P, a plurality of bins 9 serving as sheet trays are vertically spaced away from each other and supported by the outer plate 401*a*. A large part of the bins 9 extends outward beyond openings of the casing 401*a*.

A movable member 410 and a lift member 411 are set up in the vicinity of the bins between the receive rollers 6 and 7 and the bins 9. A paper guide member 412 guiding recorded paper P is disposed between the receive rollers 6 and 7 and the lift member 411. The movable member 410 and the lift member 411 are moved up and down by a transfer driver 12 and a lift driver 414. The transfer driver 12 consists of two pairs of pulleys 12*a* and 12*b* vertically spaced away from each other, a step motor 12*d* reversibly rotating and disposed in the vicinity of a revolving shaft 12*c* of the upper pulleys 12*a*, a worm gear 12*f* fixed on a drive shaft 12*e* of the step motor 12*d*, a wheel gear 12*g* engaging with the worm gear 12*f* as well as fixed on the shaft 12*c* of the pulleys 12*a*, and a pair of wires 12*h* looped over the pulleys 12*a* and 12*b*, and fixed on side plates 410*a* of the movable member 410. The pulleys 12*a* are fixed on the shaft 12*c* and the pulleys 12*b* are rotatably supported by a shaft 414*c*. The shafts 12*c* and 414*c* are supported by bearings fixed on the casing 401*a*. The step motor 12*d* is also fixed on the casing 401*a*.

On the other hand, the aforesaid lift driver 414 consists of two pairs of pulleys 414*a* and 414*b* vertically spaced away from each other, a step motor 414*d* reversibly revolving and disposed in the vicinity of the shaft 414*c* of the lower pulleys 414*b*, a worm gear 414*f* fixed on a drive shaft 414*e* of the step motor 414*d*, a wheel gear 414*g* engaging with the worm gear 414*f* as well as fixed on the shaft 414*c* of the pulleys 414*b*, and a pair of wires 414*h* looped over the pulleys 414*b* and fixed on hold members 411*b* projecting from side plates 411*a* of the lift member 411. The pulleys 414*b* are fixed on the shaft 414*c* and the pulleys 414*a* are rotatably supported by the shaft 12*c*. The step motor 414*d* is fixed inside the casing 401*a*.

The movable member 410 is substantially similar to the movable member 10 (FIG. 2) used in the embodiment shown in FIG. 1, except that a detection piece 433*a* (detailed later) is provided on the right side of a side plate 10*a*.

The movable member 410 stands by at a home position higher than a top bin 9*a*. A paper hand insert port 430 for manual insertion of special recorded paper P′ is provided close to the movable member 410 on the casing 401*a* at the far side from the electrostatic copying machine 2. In the vicinity of the paper hand insert port 430, a hand insert paper receive member 431 is provided to guide the special recorded paper P′ (inserted) to a contact portion of first followers 15 and main rollers 21.

A given short time rotation of the main rollers 21 allows recorded paper P′ (inserted in between the first followers 15 and the main rollers 21) to be pinched by the rollers 15 and 21, and then by the rollers 21 and 25. Then the movable member 410 is carried down (forward) to a position matching a target bin 9, when the main rollers 21 rotates again to discharge the recorded paper P′ on the target bin 9.

A hand insert paper roller home position sensor 433 of a photosensor type is provided at an upper portion inside the casing 401*a*. The hand insert paper roller home position sensor 433 signals that the rollers 15, 21 and 25 (for discharging the manually inserted recorded paper P′) are disposed at the home position by detecting that the detecting piece 433*a* (i.e. projecting out from the side plate 410*a* of the movable member 410) is set up in place.

Figure 21:
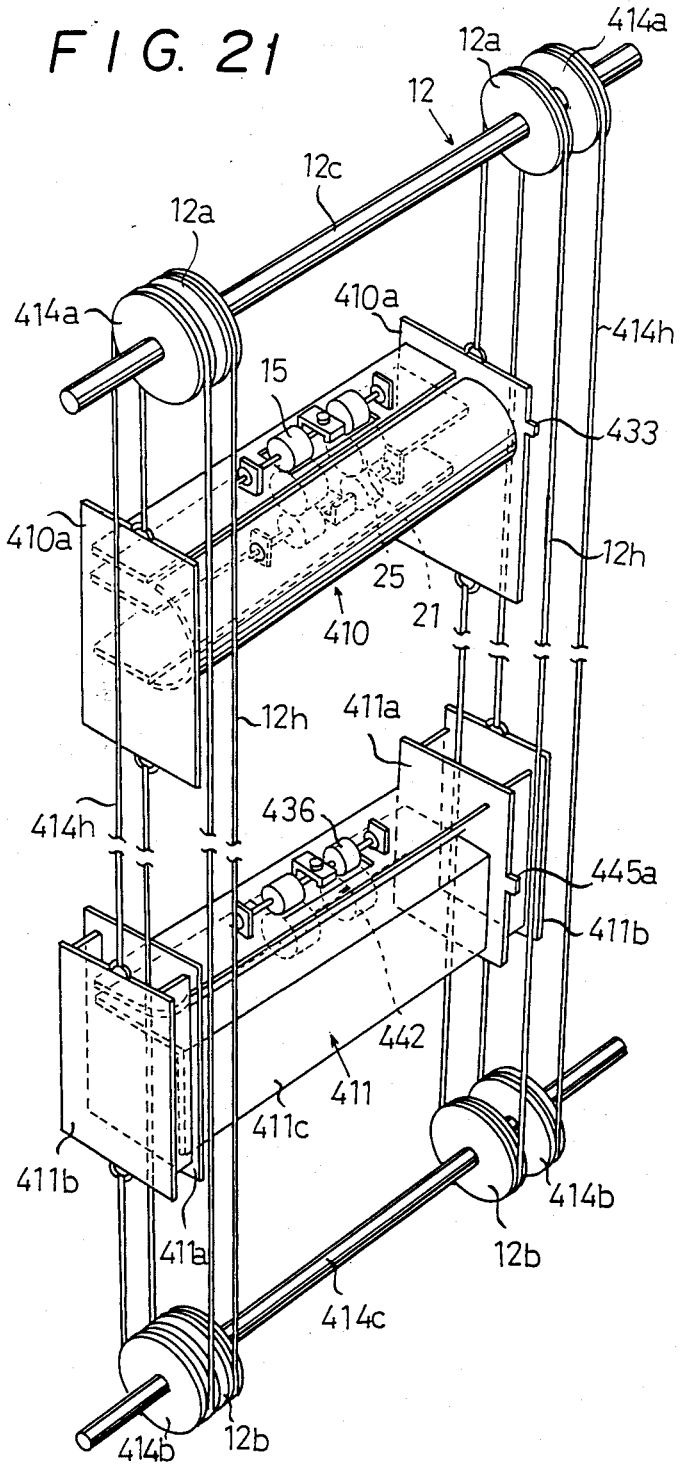
FIG. 21 is a perspective view showing a movable member and a lift for use in the sheet discharge device shown in FIG. 20.
Figure 22:
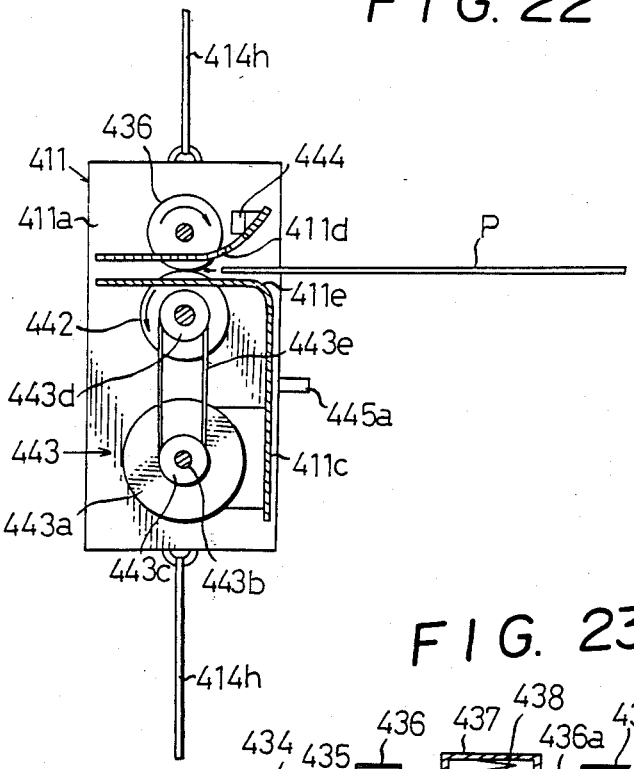
FIG. 22 is side sectional view of the lift member in FIG. 21.

As shown in FIG. 21, the lift member 411 consists of the side plates 411*a*, the hold members 411*b*, and a hold plate 411*c* integrally fixed thereto. On the side plates 411*a* and the hold plate 411*c*, two paper guide members 411*d* and 411*e* (FIG. 22) are provided to guide the recorded paper P fed from the receive rollers 6 and 7 (FIG. 20).

Figure 23:
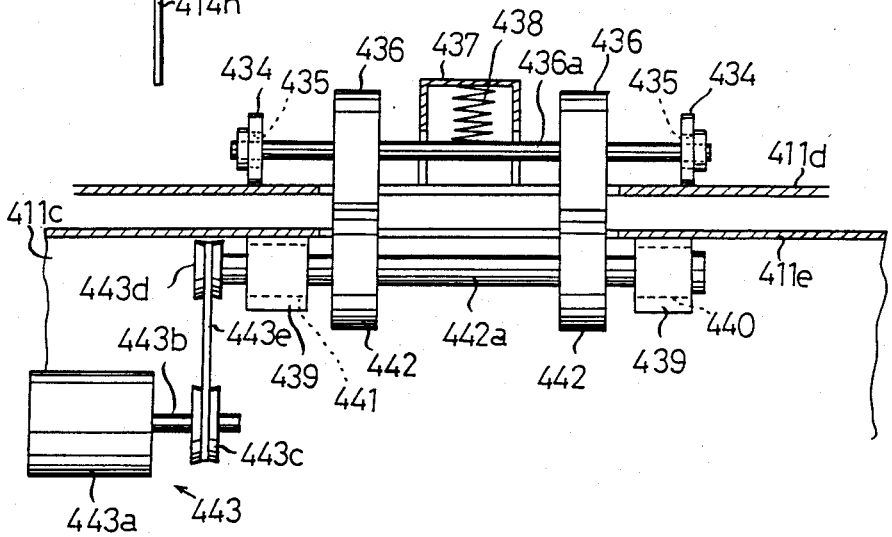
FIG. 23 a front sectional view of the aforesaid lift member.

As shown in FIG. 23, two support projections 434 are provided on the paper guide member 411*d*. Slots in the support projections 434 house bearings 435 so that the bearings 435 can slight play up and down. The bearings 435 support a shaft 436*a* of paper discharge rollers 436. A hold projection 437, provided on the paper guide member 411*d*, houses therein a spring 438 to press down the shaft 436*a* of the paper discharge rollers 436.

The aforesaid paper guide member 411*e* is also provided with two support projections 439, which incorporate one-way clutches 440 and bearings 441 to support a shaft 442*a* of mate (driving) paper discharge rollers 442. The paper discharge rollers 442 are driven by a paper discharge roller driver 443*a* consisting of a motor 443*a* fixed on the hold plate 411*c* of the lift member 411, a pulley 443*c* fixed on a drive shaft 443*b* of the motor 443*a*, a pulley 443*d* (opposite to the pulley 443*c*) fixed on the shaft 442*a* of the paper discharge rollers 442, and a belt 443*e* looped over the pulleys 443*c* and 443*d*. The one-way clutches 440 allow the driving paper discharge rollers 442 to rotate in such a direction as to feed recorded paper P toward the bins 9, but does not allow reverse rotation.

A paper sensor 444 detecting recorded paper P is disposed close to the paper discharge rollers 436 and 442 in between the paper discharge rollers 436 and 442 and the receive rollers 6 and 7. The paper sensor 444 of a photosensor type is fixed on the paper guide member 411*d*. A roller home position sensor 445 also of a photosensor type is disposed in a given position (FIG. 20) to inform that the paper discharge rollers 436 and 442 stand by at a home position located lower than a bottom bin 9, by detecting that a detecting piece 445*a* (projecting from the side plate 411*a* of the lift member 411) has reached a given position.

In FIG. 20, the receive rollers 6 and 7 feed recorded paper P (which has been transferred from the paper discharge rollers 4 in the electrostatic copying machine 2) toward the paper discharge rollers 436 and 442. At this time, the paper discharge rollers 436 and 442 are standing by at the home position for receiving recorded paper P. When the paper sensor 444 (FIG. 22) detects a leading edge of recorded paper P, the paper discharge rollers 436 and 442 start to rotate for a while in such a direction as to feed recorded paper P toward to the bins 9, and then come to a halt to pinch the leading edge of recorded paper P therebetween.

As soon as the paper discharge rollers 436 and 442 pinch the recorded paper P, the lift member 411 moves upward toward a target bin 9 and stops at a position matching the target bin 9. While the lift member 411 is moving, the recorded paper P (pinched by the paper discharge rollers 436 and 442) cannot get out of them 436 and 442 by way of the one-way clutches 440 keeping from the reverse rotation of the paper discharge rollers 442.

On reaching a position matching the target bin 9, the paper discharge rollers 436 and 442 are again rotated in the previous direction to discharge the recorded paper P (pinched thereby) to the target bin 9. A fixed short time after the paper sensor 444 detected a trailing edge of the recorded paper P, the paper discharge rollers 436 and 442 are brought to a stop, and then the lift member 411 and the paper discharge rollers 436 and 442 return to the home position to stand by.

An operation indicating panel 430 provided on top of the casing 2*a* of the electrostatic copying machine 2 is basically similar to the operation indicating panel 30 (FIG. 4). Therefore a description is made referring to FIG. 4. The operation indicating panel 430 is additionally provided with a hand insert paper sort mode key 455 to set the hand insert paper sort mode, and a hand insert paper sort mode indicator 456 to indicate that the hand insert paper sort mode is established.

Figure 24:
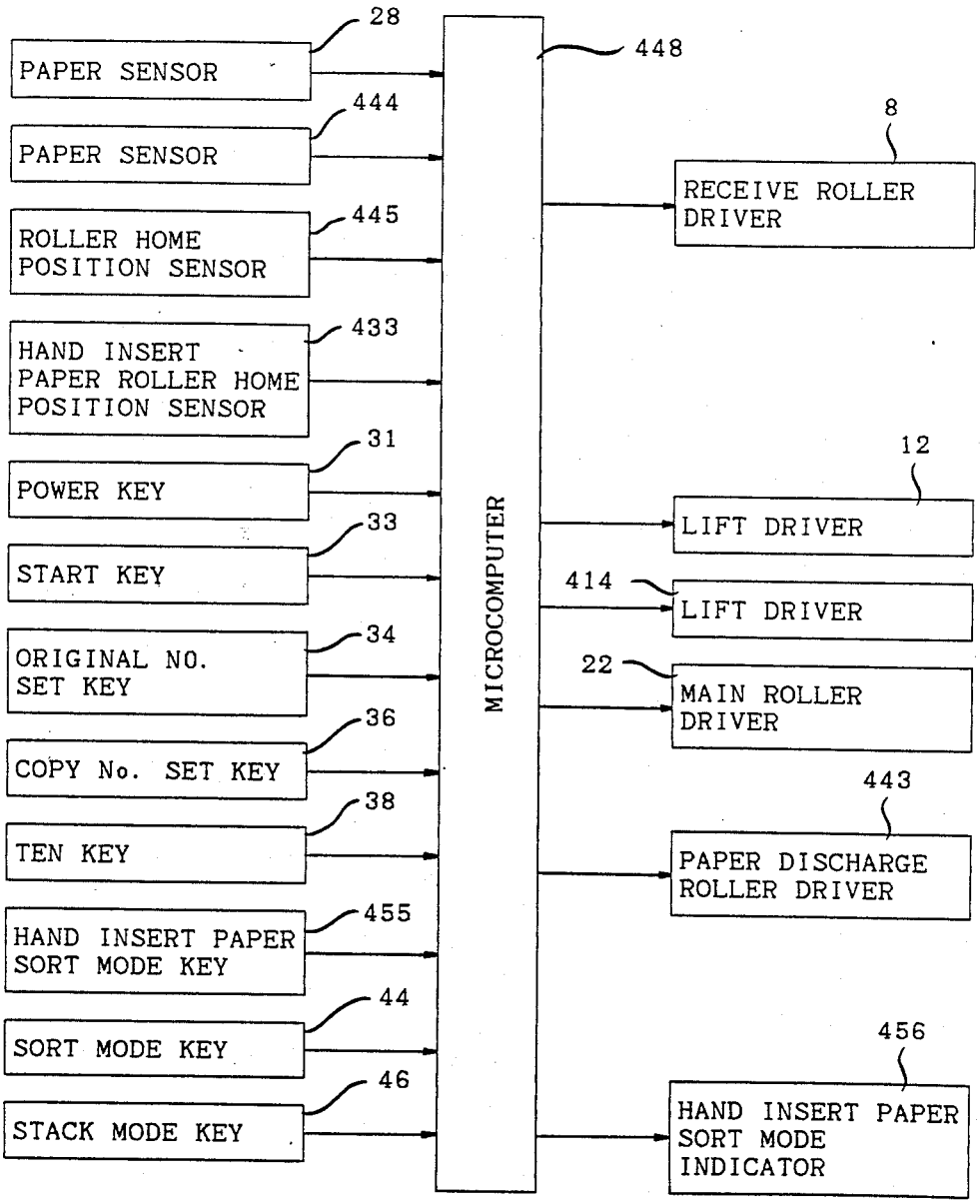
FIG. 24 is a block diagram of a control operation for the sheet discharger in FIG. 20.

The controller for use in the embodiment, as shown in FIG. 24, has a roller home position sensor 445 and a hand insert paper roller home position sensor 433, (which are both connected to an input port of a microcomputer 448) rather than the roller home position sensor 29 (FIG. 1) in FIG. 5. Additionally to the controller in FIG. 5; the paper sensor 444 and the hand insert paper sort mode key 455 are also linked to the input port as well as the lift driver 414, the paper discharge roller driver 443 and the hand insert paper sort mode indicator 456 are connected to an output port of the microcomputer 448.

The RAM in the microcomputer 448 additionally stores a hand insert paper discharge counter and a hand insert paper sort mode flag. The hand insert paper sort mode flag is turned "1" when the hand insert paper sort mode key 455 is turned ON.

Figure 25A:
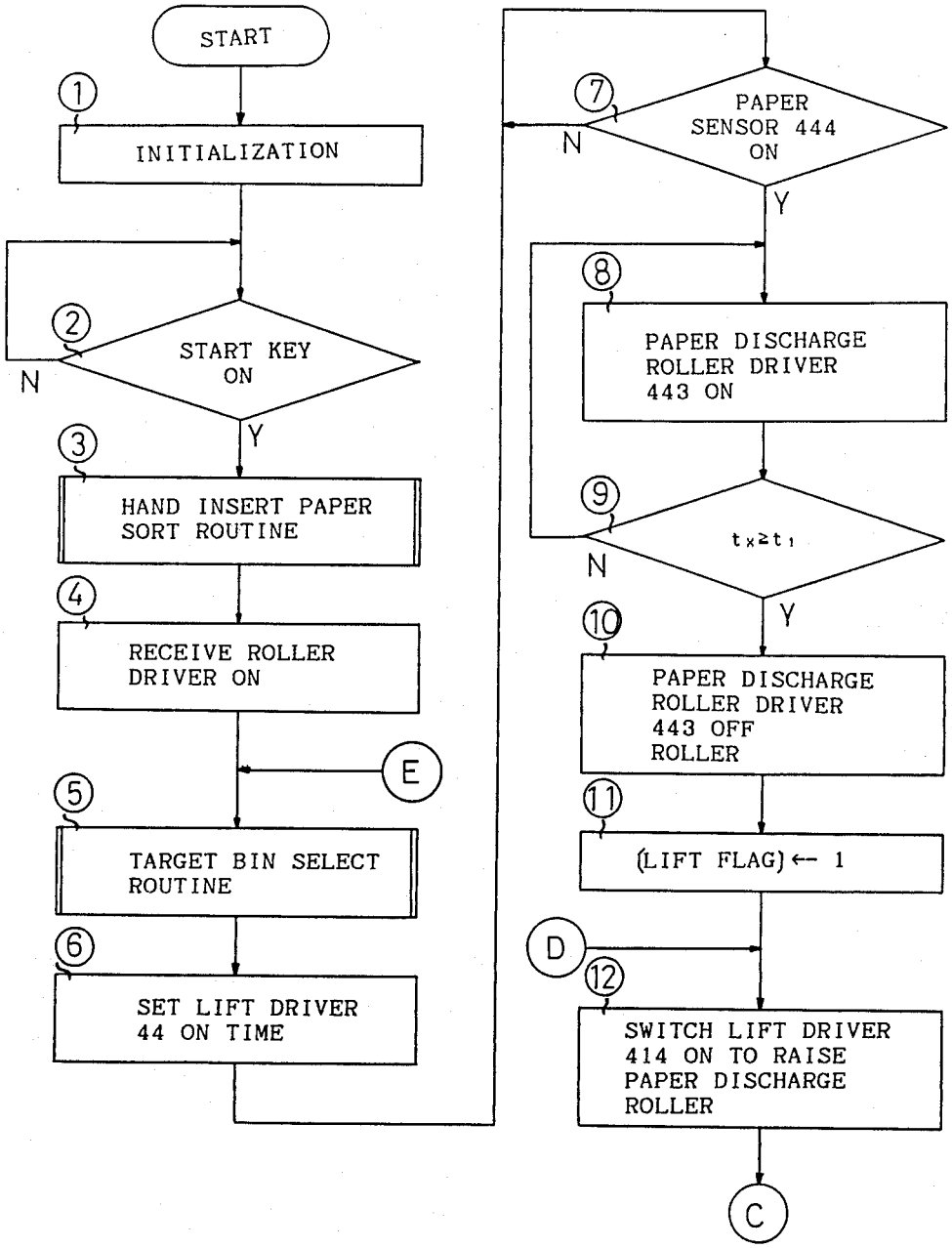
FIGS. 25*a* to 27 are control flow charts in use the aforesaid control operation.
Figure 25B:
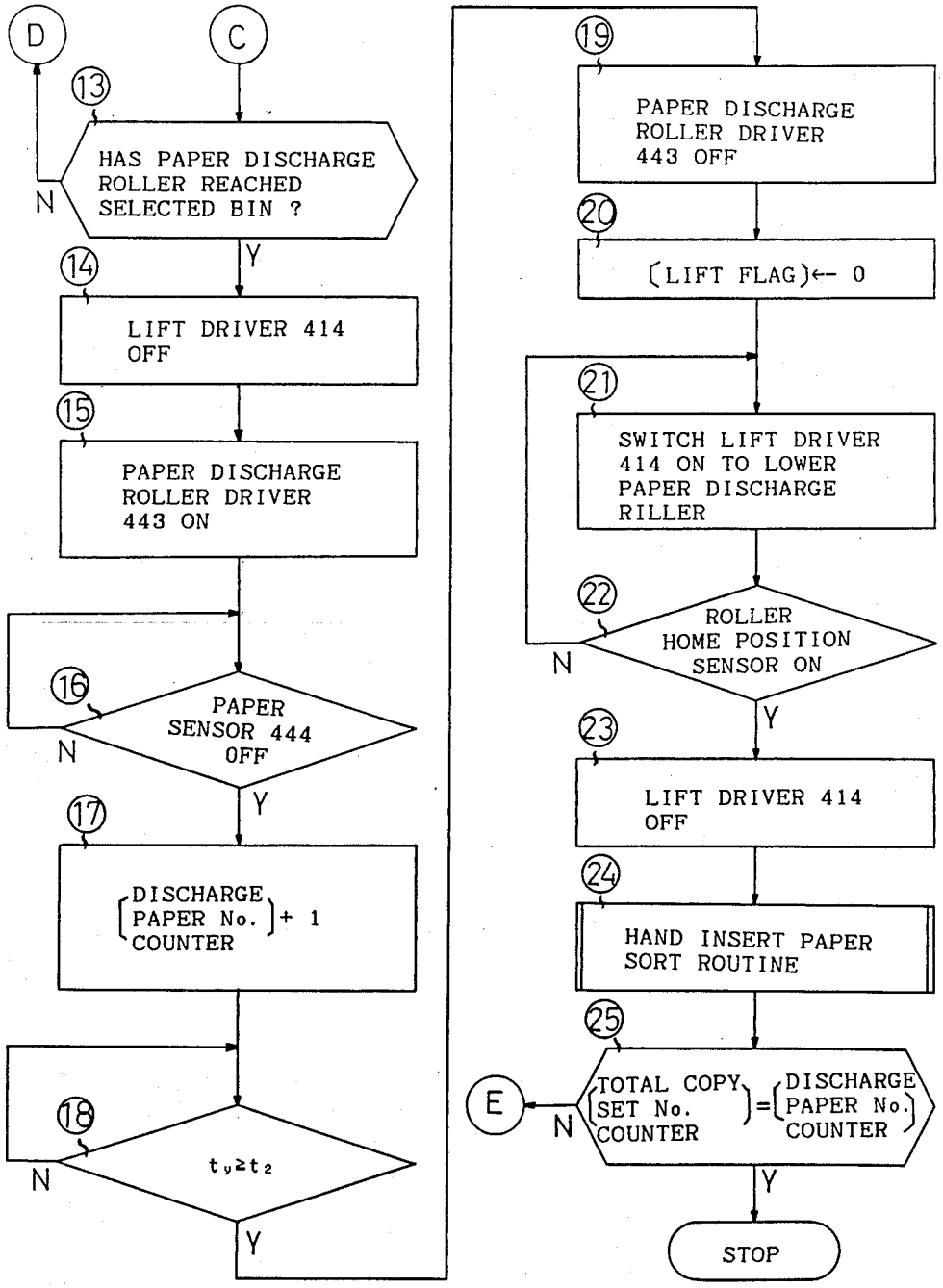

Following is the description of an example of the operation of the sheet discharge device 401, referring to FIGS. 25*a* to 27. In FIGS. 25*a* and 25*b*, Step 1 initializes the system. Step 2 checks whether the START key 33 is ON. If it is ON, step goes to Step 3 (hand insert paper sort routine), Step 4 turns ON the receive roller driver 8, and through Step 5 (target bin select routine), Step 6 sets On-time of the lift driver 414 according to a bin 9 selected in the target bin select routine.

Then, Step 7 checks if the paper sensor 444 has been turned ON or NOT. If Step 7 determines that the paper sensor 444 has been ON, i.e., the paper sensor 444 has detected a leading edge of recorded sheet P, Step 8 turns ON the paper discharge roller driver 443, and then Step 9 checks if $t_x$ is larger than or equal to $t_1$ or not. Here, $t_x$ is an elapse time from the instant when the paper sensor 444 became ON, and t a time, from the instant when the paper sensor 444 became ON i.e. when the paper discharge roller driver 443 was turned ON), required for the paper discharge rollers 436 and 442 to pinch the leading edge of recorded sheet P.

If the aforesaid Step 9 determines that $t_x$ is larger than or equal to $t_1$, Step 10 turns OFF the paper discharge roller driver 443, Step 11 makes the lift flag "1", Step 12 turns ON the lift driver 414 to lift (move forward) the paper discharge rollers 436 and 442. Next, Step 13 checks if the paper discharge rollers 436 and 442 have reached or not a bin 9 selected by the Step 5, target bin select routine, in other words, checks if the lift driver 414 is kept ON or not for the ON-time of the lift driver 414 set in the Step 6.

If the Step 13 determines that the paper discharge rollers 436 and 442 do not have reached the selected bin 9, the flow is returned to the Step 12 to keep ON the lift driver 414. If the Step 13 determines that the paper discharge rollers 436 and 442 have reached the selected bin 9, Step 14 turns OFF the lift driver 414, and after Step 15 turns ON the paper discharge roller driver 443, Step 16 checks if the paper sensor 444 is OFF or NOT.

If the Step 16 determines that the paper sensor 444 is OFF, or the paper sensor 444 detects the trailing edge of recorded sheet P, Step 17 adds 1 to a value of recorded sheet discharge No. counter and then Step 18 checks if $t_y$ is larger than or equal to $t_2$ or not, where $t_y$ is an elapse time from the instant when the Step 16 determined that the paper sensor 444 was OFF, and $t_2$ is a time, from the instant when the Step 16 determined that the paper sensor 444 was OFF, required for recorded sheet P discharged by the paper discharge rollers 436 and 442 to get out of the paper discharge rollers 436 and 442.

If the aforesaid Step 18 determines that $t_y$ is larger than or equal to $t_2$, Step 19 turns OFF the paper discharge roller drive 443. Step 20 makes the lift flag "0", and Step 21 turns ON the lift driver 414 to lower (move backward) the paper discharge rollers 436 and 442. Next, Step 22 checks if the roller home position sensor 445 is turned ON or NOT. If Step 22 determines that the roller home position sensor 445 is not turned ON, the flow is returned to the Step 21 to keep ON the lift driver 414.

If the aforesaid Step 22 determines that the roller home position sensor 445 is ON, Step 23 turns OFF the lift driver 414 to place the paper discharge rollers 436 and 442 at the home position, and through Step 24 (hand insert paper sort routine), Step 25 checks if the total copy set No. counter equals the discharged sheet No. counter or not. If the Step 25 determines that the total copy set No. counter does not equal the discharged sheet No. counter, the flow is returned to the Step 5. When the Step 25 determines that the total copy set No. counter equals the discharged sheet No. counter, a complete cycle of this operation is over.

The target bin select routine in the Step 5 is similar to that in FIG. 7.

Figure 26A:
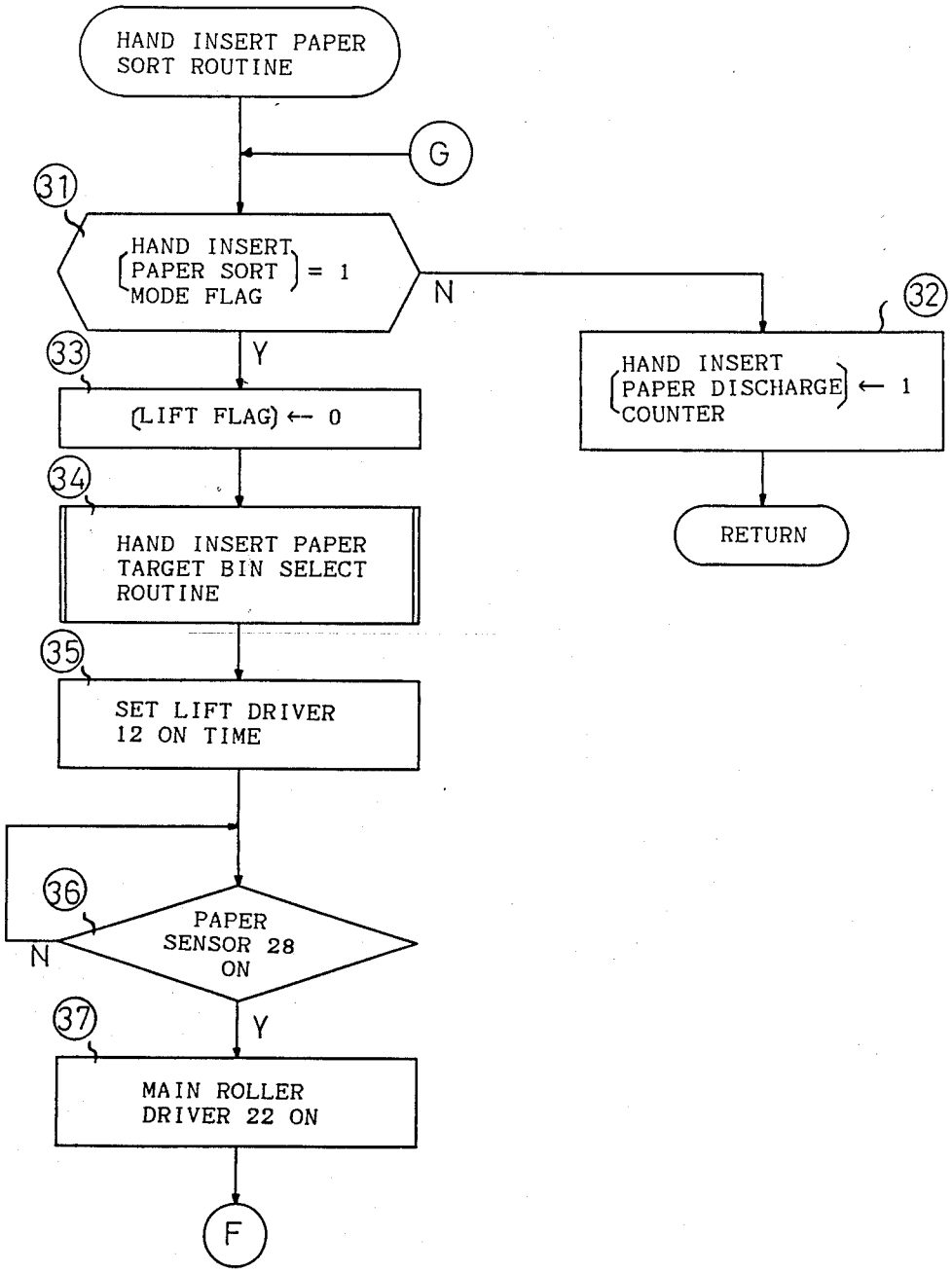
Figure 26B:
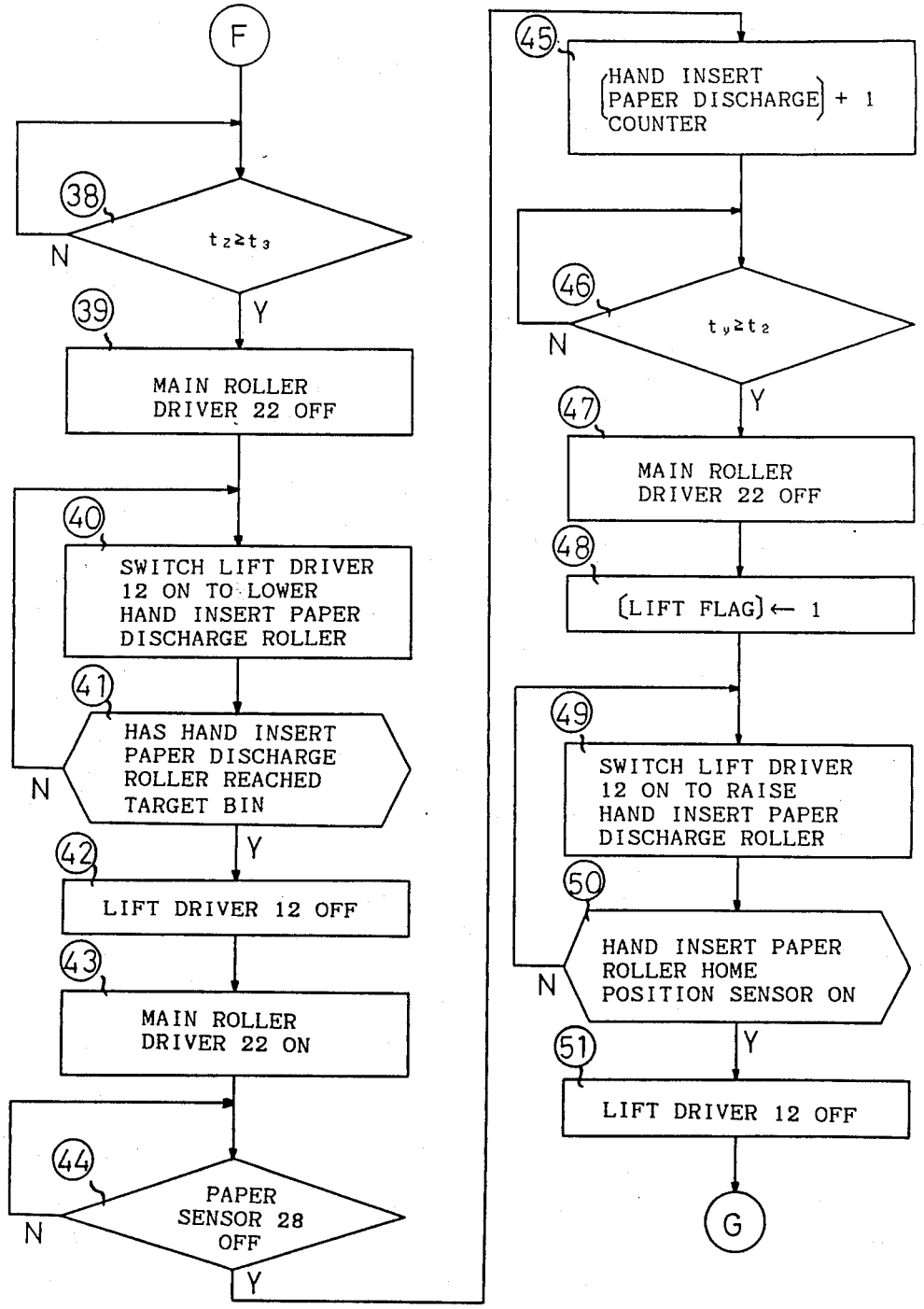

The hand insert paper sort routine in the Step 3 is shown in FIGS. 26*a* and 26*b*.

First, Step 31 checks if the hand insert paper sort mode flag equals "1" or not. If the Step 31 determines the hand insert paper sot mode flag is not equal to 1, Step 32 turns hand insert discharge paper no. counter "0", and step returns to the main routine.

If Step 31 determines that hand insert paper sort mode flag $=1$, the next step is to Step 33. The Step 33 turns lift flag "0", through Step 34 (hand insert paper target bin select routine), Step 35 sets ON-time of the lift driver 12, and Step 36 checks if the paper sensor 28 is ON.

If Step 36 determines that the paper sensor 28 is ON, Step 37 turns ON the main roller driver 22, and Step 38 checks if $t_z$ is larger than or equal to $t_3$, where $t_z$ is an elapsed time after the paper sensor 28 is turned ON, and $t_3$ is a fixed time required for the rollers 15, 21 and 25 to pinch the leading edge of the hand insert recorded paper P' after the paper sensor 28 is turned ON.

If the Step 38 determines $t_2$ is larger than or equal to $t_3$, the flow advances to Step 39 which turns OFF the main roller driver 22, and Step 40 turns ON the lift driver 12 to lower the rollers 15, 21 and 25. Step 41 checks if the rollers 15, 21 and 25 have reached the selected bin 9, i.e. if the lift driver 12 has been ON for the ON-time of the lift driver 12 set in the Step 35.

If Step 41 determines the rollers 15, 21 and 25 have not reached the selected bin 9, the flow returns to the Step 40 to keep the lift driver 12 ON. If Step 41 determines the rollers 15, 21 and 25 have reached the selected bin 9, the flow returns to the Step 42 to turn OFF the lift driver 12, Step 43 turns ON the main roller driver 22, and Step 44 checks if the paper sensor 28 is OFF. If Step 44 determines the paper sensor 28 is OFF, Step 45 adds "1" to hand insert discharge paper No. counter, and Step 46 checks if $t_y$ is larger than or equal to $t_2$, where $t_y$ is an elapsed time after the paper sensor 28 is turned OFF in the Step 44, and $t_d$ is a fixed time required for the rollers 15, 21 and 25 to release a trailing edge of recorded paper P' after the paper sensor 28 has been determined "OFF" in the Step 44.

If Step 46 determines $t_y$ is larger than or equal to $t_2$, the flow advances to Step 47 which turns OFF the main roller driver 22, and Step 48 turns lift flag "1", Step 49 turns ON the lift driver 12 to lift the rollers 15, 21 and 25. Step 50 checks if the hand insert paper roller home position sensor 433 is ON. If Step 50 determines hand insert paper roller home position sensor 433 is NOT ON, the flow returns to Step 49 to keep the lift driver 12 ON. If Step 50 determines hand insert paper roller home position sensor 433 is ON, Step 51 turns OFF the lift driver 12, and the flow returns to Step 31.

Figure 27:
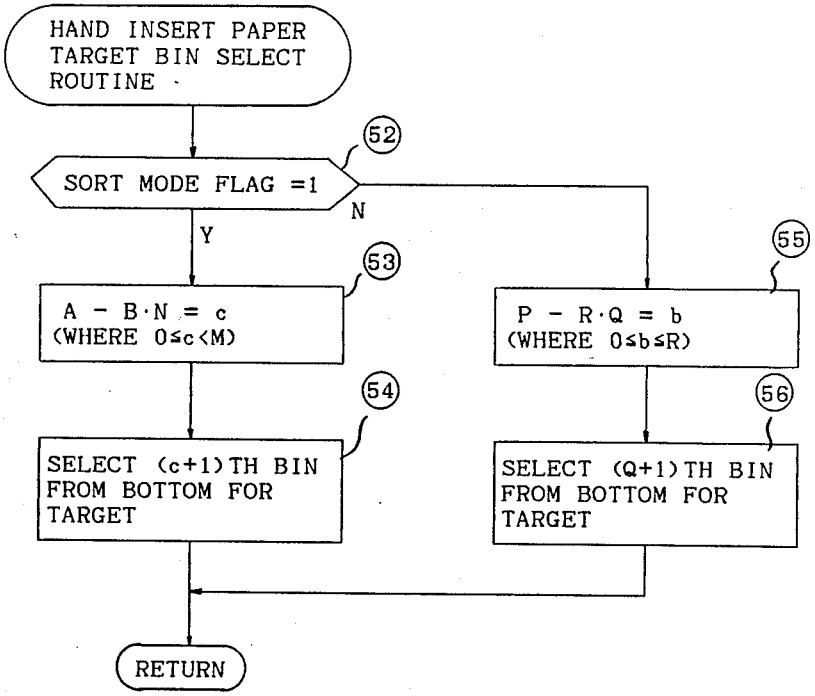

Following is a description of the hand insert paper target bin select routine in FIG. 27.

Step 52 checks if sort mode flag $=1$. If Step 52 determines sort mode flag $=1$, Step 53 finds N and c to satisfy $A - BN = c$ (where $0 \leqq c < B$), where the A and B are the values of the hand insert discharge paper No, counter and the target bin No. counter, and N and c are zero or positive integer. Using the c solved in the Step 53, Step 54 selects a $(c+1)$th bin 9 from bottom as a target bin 9 and returns the flow back to the main routine.

If the Step 52 determines the sort mode flag is not "1", that is, Step 55 finds Q and b to satisfy $P - RQ = b$ (where $0 \leqq b \leqq R$), where the aforesaid R is a maximum No. of recorded sheets P to be stacked on a bin 9, and Q and b are zero or positive integer. Using the Q solved in the Step 55, Step 56 selects a $(Q+1)$th bin 9 from bottom as a target bin 9 and returns the flow back to the main routine.

Figure 28:
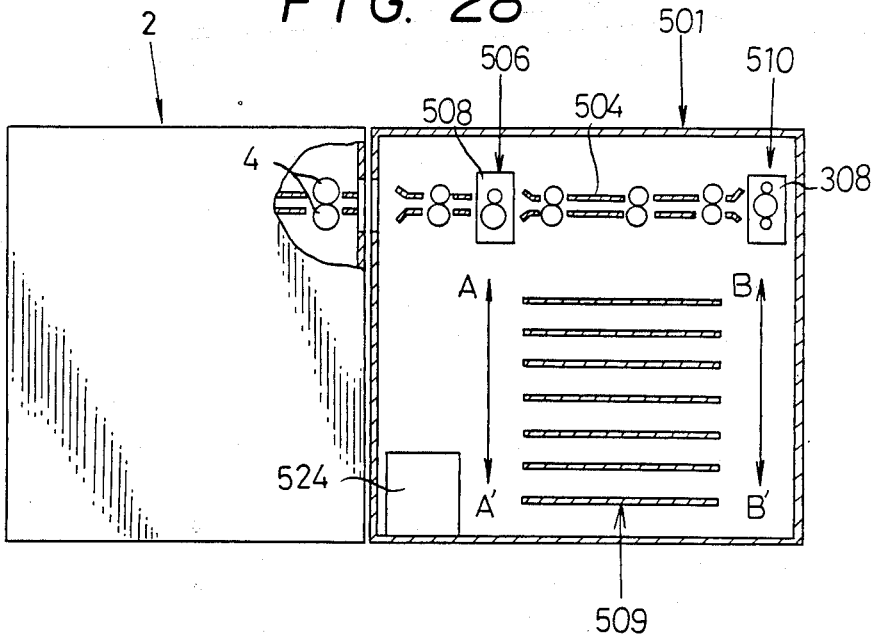
FIG. 28 is side sectional view of the sixth embodiment of a sheet discharge device according to the invention.

FIG. 28 shows another embodiment according to the invention, in which a copying machine 2 is provided with a sheet discharge device 501. Recorded sheets of paper fed from the copying machine 2 are discharged by paper discharge rollers 4. The sheet discharge device 501 consists of a sheet carry path 504 receiving recorded paper discharged from the copying machine, a plurality of sheet trays 509 (for example 7 pieces in FIG. 28) to stack recorded sheets, a first movable member 510 and a second movable member 506. Each of the sheet trays 509 has two sheet receiving openings separated from each other at the far right and left sides thereof in FIG. 28.

Figure 29:
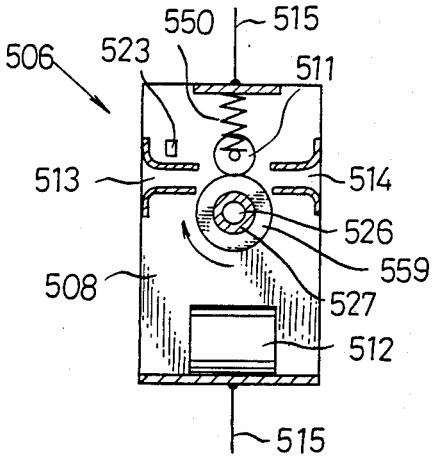
FIG. 29 is a side sectional view of a movable member in use for the aforesaid sheet discharge device.
Figure 30:
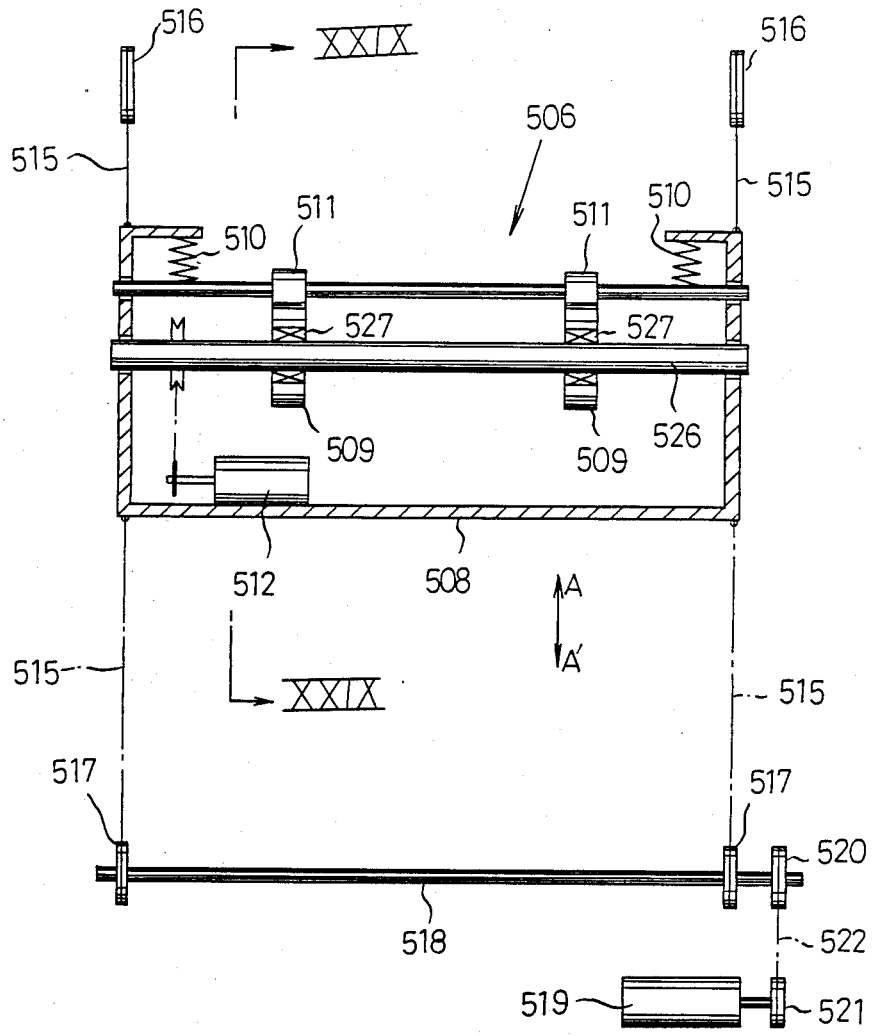
FIG. 30 is a front sectional view of the aforesaid movable member.

The second movable member 506 situated at the middle of the sheet carry path 504 is, as shown by the side view in FIG. 29 and the front view in FIG. 30, provided with a support casing 508, and a sheet receive port 513 and a sheet discharge port 514, each port being provided inside the support casing 508. The support casing 508 also supports paper discharge rollers 511 and 559. The upper paper discharge rollers 511 are depressed down against the lower paper discharge rollers 559 by springs 550. The lower paper discharge rollers 559 are rotated clockwise (in FIGS. 28 and 29) by a motor 512. The sheet receive port 513 is disposed at the left side of the paper discharge rollers 511 and 559. On the other hand, the sheet discharge port 514 is at the right side thereof. Recorded paper inserted from the sheet receive port 513 is linearly carried to the sheet discharge port 514 disposed opposite thereto by the lower paper discharge rollers 559.

As shown in FIG. 30, the support casing 508 is connected to a lift driver which consists of wires 515, upper and lower pulleys 516 and 517 looped over by the wires 515, a drive shaft 518 supporting the two lower pulleys 517, a motor 519 rotating the drive shaft 518, power transmission pulleys 520 and 521, and a separate wire 522. When the motor 519 is actuated, the wires 515 are pulled vertically, which vertically travels the supporting casing 508 as shown by Arrow AA'. In FIG. 29, a sheet detect sensor 523, situated at the sheet receive port 513, detects a leading edge of recorded paper reaching the port 513 and sends a sheet detect signal to a controller 524 (having a built-in microcomputer) provided on bottom of the sheet discharge device 501 in FIG. 28.

Figure 31:
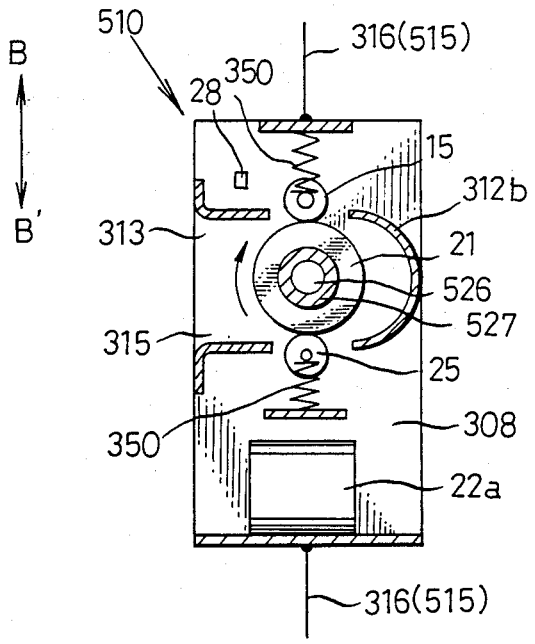
FIG. 31 is a side sectional view of another movable member in use for the sheet discharge device in FIG. 28.

The first movable member 510 disposed at the right side of the sheet carry path 504 as shown in FIG. 28 has the same construction (FIG. 31) as that of the movable member 31 in FIG. 17 (if the right and left are replaced with each other), excepting that a one-way clutch 527 disposed between a main roller 21 and the roller drive shaft 526 is shown in FIG. 31. Therefore, in FIG. 31, like numerals are provided for like parts as those in FIG. 17, and a further explanation is thereof eliminated. The lift mechanism comprising the wires 515 and the motor 519, etc. in FIG. 30 can be used for a lift mechanism for the first movable member 510.

The sheet discharge device 501 can conduct two different sheet carry modes according to a program stored in the microcomputer in the controller 524: 1) a normal sort mode wherein recorded sheets discharged from the copying machine 2 are sorted into the respective sheet trays 509 directly with the recorded side of sheet on top, and 2) a reverse sort mode wherein recorded sheets are sorted into the trays 509 with the recorded, side of sheet turned to bottom. Following is a description of the operation of both modes.

NORMAL SORT mode

The second movable member 506 is at first disposed in the sheet carry path 504 as shown in FIG. 28. Recorded paper fed by the pair of paper discharge rollers 4 in a copying machine 2 is carried into the sheet receive port 513 (FIG. 29) in the second movable member 506 through the sheet carry path 504. When detecting a leading edge of recorded paper, the sheet detect sensor 523 sends a sheet detecting signal to the controller 524 (FIG. 28).

The controller 524 rotates the paper discharge rollers 559 for a fixed short time after receiving the sheet detect signal, and then brings the rollers 559 to a stop, which allows a leading edge of the copying product to be pinched between the paper discharge rollers 559 and 511 and to be brought to a halt as it is.

Then, the controller 524 actuates such driving means for the support casing 508 as the wires 515 (FIG. 30) to lower the support casing 508 from its original position (FIG. 28) down to the front of a desired sheet tray 509. After the support casing 508 is stopped, the paper discharge rollers 559 again start rotation to transfer of recorded paper from the sheet receive port 513 to the sheet discharge port 514 in the second movable member 506 prevents the recorded side of paper from being turned over.

After stacking a recorded sheet of paper, the support casing 508 is again lifted up to the original home position (FIG. 28) to receive a following sheet. The same operation as the above is repeated to perform sorting onto the sheet trays 509.

REVERSE SORT mode

As shown in FIG. 28, the first movable member 510 and the second movable member 506 are at first disposed in the sheet carry path 504. In the course of this mode, the paper discharge rollers 559 in the second movable member 506 are left continuously or freely rotated so that recorded paper sent can freely pass therethrough.

Recorded sheet fed from the copying machine 2 is carried through the second movable member 506 and the sheet carry path 504 until it is pinched in the first movable member 510 in the same manner as that in the second movable member 510 in the NORMAL SORT mode.

Then, the support casing 308 of the first movable member 510 is pulled by the wires 316 (515) down to the front of a desired sheet tray 509 (the right side in FIG. 28). Clockwise rotation of the main rollers 21 (FIG. 31) causes recorded paper to be turned over through the reverse path made of the guide plate **312*b* and then to be stacked in the sheet tray 509 via the sheet discharge port 315**.

After stacking recorded paper, the support casing 308 is reset to the original position in FIG. 28. Then the same operation is recycled to sort recorded sheets into the sheet trays 509 with the recorded side of paper being turned to the bottom.

The one-way clutches 527 (FIG. 29 and 31) keep the paper discharge rollers 559 (FIG. 29) and the main rollers 21 (FIG. 31) from rotating reversely to the sheet carry direction (clockwise in both figures), so that there is no chance of slip of pinched sheets when the second and first movable members 506 and 510 are travelling toward the sheet trays 509.

The first movable member 510 and each of its attachments therein, mainly functioning the reverse transfer of recorded sheets, can be employed in many other configuration than that shown in FIG. 31. The reverse transfer of recorded sheets can be naturally realized by the configuration shown in FIGS. 9 and 10, that is, by the second rollers 107 epicyclically rotated around the first rollers 106.

Figure 32:
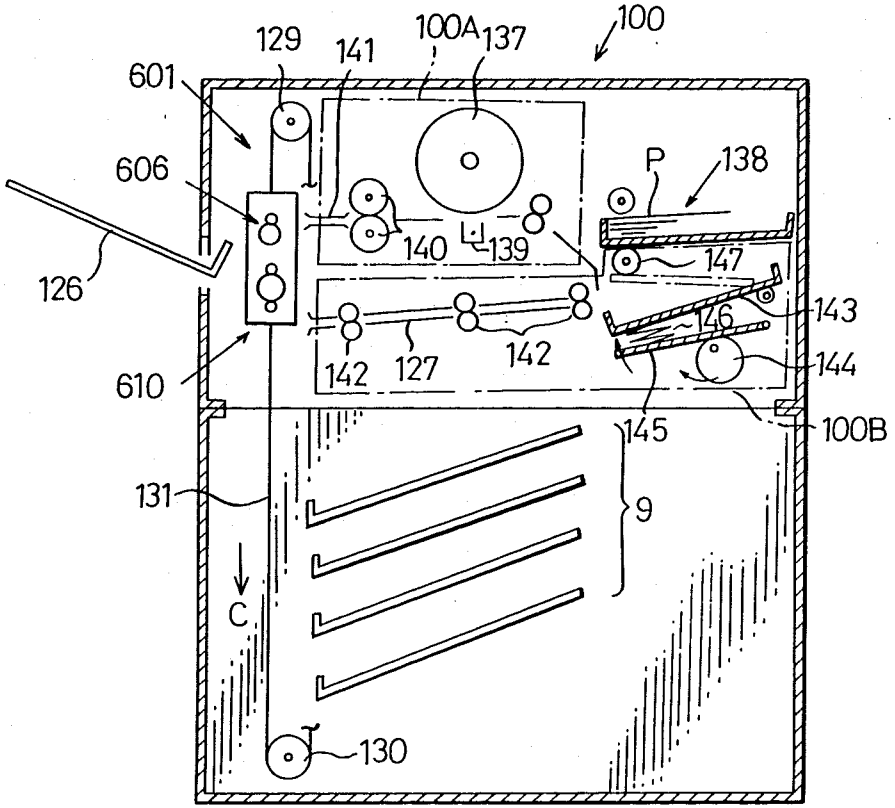
FIG. 32 is a side sectional view of a system using the seventh embodiment of a sheet discharge device according to the invention.

FIG. 32 shows another embodiment according to the invention. A sheet discharge device 601 according to the invention performs various sheet carry modes similarly to the sheet discharge device 101 in FIG. 8:

Normal PAPER DISCHARGE mode wherein recorded sheets discharged from an image copying means 100A in a sheet handling device 100 are directly discharged on a paper discharge tray 126, Double SIDE COPY mode wherein recorded sheets are fed back to the image copying means 100A through a reverse carrier 100 B, and SORT mode wherein recorded sheets are sorted into a plurality of sorter bins 9.

In FIG. 32, the sheet handling device 100 is the same as that shown in FIG. 8. Therefore, like reference numbers are given for like parts and further description thereof is eliminated.

Figure 33:
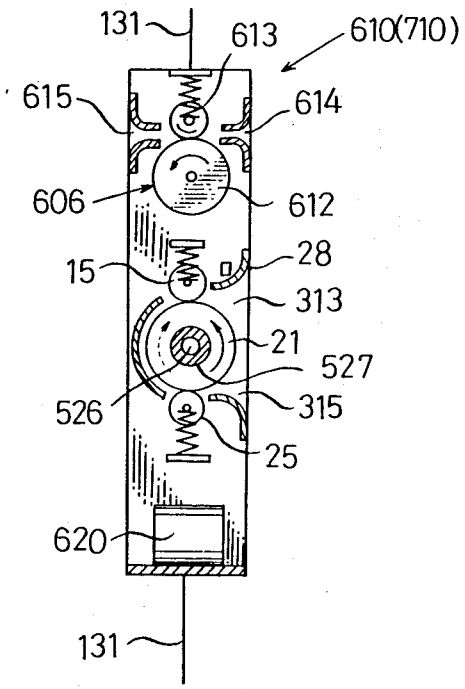
FIG. 33 is a side sectional view of a movable member in use for the aforesaid sheet discharge device.

The sheet discharge device 601 is provided with a movable member 610 of different configuration from that of the movable member 110 in FIG. 8. As shown in FIG. 33, the movable member 610 has a sheet carrier 606 which linearly carries recorded paper inserted from a sheet receive port 614 through a sheet discharge port 615, in addition to the main rollers 21 and the followers 15 and 21 used as sheet pincher, sheet discharger and sheet carry direction changer. A sheet carrier 606 comprises carry rollers 612 rotated counterclockwise in the figure by a motor 620 set on the bottom of the movable member 610, and the followers 613 driven thereby under pressure contact therewith. These rollers linearly carry recorded sheets. In the embodiment, the main rollers 21 are rotated counterclockwise in FIG. 33 by the motor 620 to discharge recorded sheets (inserted from the sheet receive port 313) out of the sheet discharge port 315.

In FIG. 32, with the NORMAL PAPER DISCHARGE mode wherein recorded sheets transferred from the paper discharge path 141 in an image copying means 100A are discharged directly on a normal paper discharge tray 126, the movable member 610 is so positioned as shown in FIG. 32 as to set the sheet carrier 606 between the paper discharge path 141 and the paper discharge tray 126. Accordingly, the recorded sheets transferred through the paper discharge path 141 would be directly discharged on the paper discharge tray 126 by the aid of the carry rollers 612 and the followers 613.

Figure 34:
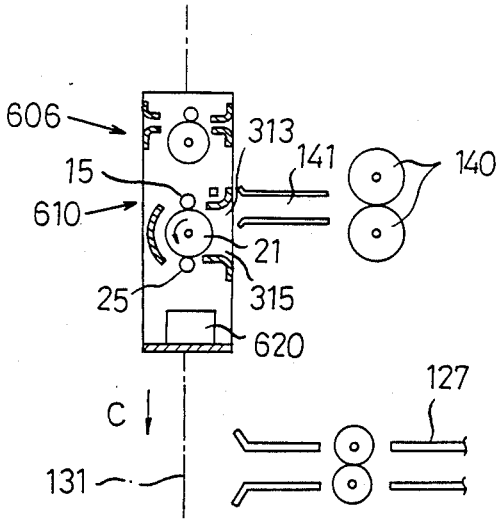
FIG. 34 is a schematic diagram showing how the sheet discharge device moves.

With the DOUBLE SIDE COPY mode wherein another original image is to be copied on the reverse (yet blank) side of a once-recorded sheet as well, the movable member 610 is pulled up to face the sheet receive port 313 (for the main rollers 21) toward the paper discharge path 141, as shown in FIG. 34. The recorded sheet discharged out of the pair of fixing rollers 140 is pinched by the main rollers 21 and the followers 15 and then 25 at the leading edge thereof, and then comes to a stop. Thereafter, the movable member 610 is so lowered as to face the sheet discharge port 315 (for the main rollers 21) toward the reverse path 127 in the reverse carrier 100B by pulling the wires 131 downward as shown by Arrow C. A counterclockwise rotation of the main rollers 21 ipon being restarted allows the pinched recorded sheet to be carried into the reverse path 127. As described above referring to FIG. 8, an image is copied on the reverse surface of the recorded sheet fed into the reverse path 127. While the reverse side copying is being carried out, the movable member 610 is returned back to the initial position in FIG. 32 by the wires 131, thus waiting for the double side copied sheet being transferred from the paper discharge path 141 to discharge the sheet on the paper discharge tray 126 by the carry rollers 612 and the followers 613.

With the SORT mode wherein copied sheets are not discharged on the normal paper discharge tray 126, but sorted into a plurality of sorter bins 9, firstly (in a similar way to that of the aforesaid reverse carrying), the sheet receive port 313 for the main rollers 21 is faced to the paper discharge path 141 as shown in FIG. 34, to pinch a leading edge of the recorded sheet discharged therefrom by the main rollers 21 and the followers 15 and 25. Secondly, the movable member 610 is moved down toward the target sorter bin 9 by the wires 131, and brought to a stop in front of a target bin (FIG. 32). Rotation of the main rollers 21 (restarted instantly) allows recorded sheets to be discharged in the target bin 9. The vertical travel of the movable member 610 along with the pinching and transfer of recorded sheet by the main rollers 21 and the followers 15 and 25 is repeated every time recorded sheets are discharged from the pair of fixing rollers 140 to complete this sorting cycle.

Figure 35:
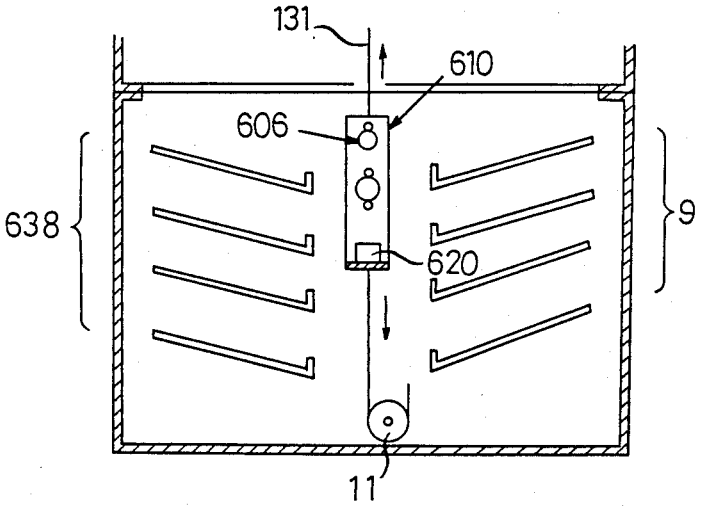
FIG. 35 is a side sectional view showing the main parts of the eighth embodiment according to the invention.

This pinching and carrying function is imparted limitedly to the main rollers 21 and the followers 15 and 25 in the above description, but it may be provided also to the carry rollers 612 and the followers 613 in the sheet carrier 606 in a similar way. In this case, as shown in FIG. 35, recorded sheets can be sorted further on sorter bins 638 arranged on the left side of the movable member 610 in addition to the sorter bins 9 on the right side thereof.

Figure 36:
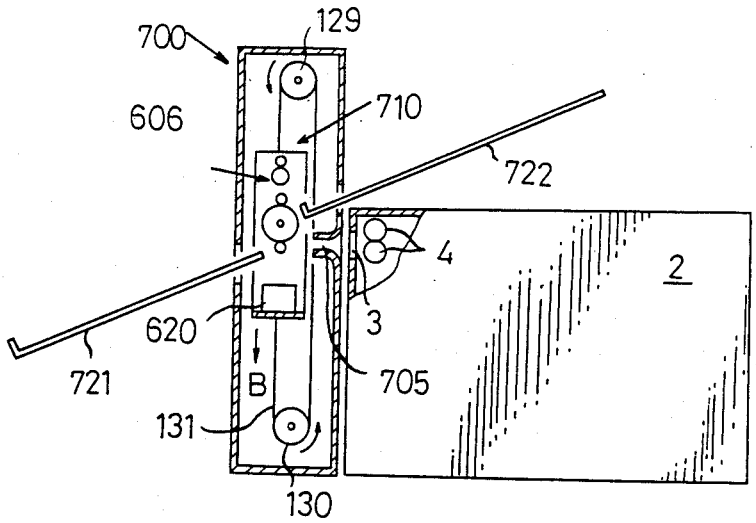
FIGS. 36 and 37 are side sectional views of an embodiment of sheet discharge devices related to the invention.

The description of the movable member 610 in FIG. 33 is made conditional on the fact that roller 21 and the followers 15 and 25, and, if required, the carry rollers 612 and the followers 613 too, have the sheet pinching function. Therefore, the travel of the movable member 610 while pinching recorded sheet therein cannot be expected unless these respective rollers have also any sheet pinching capability, but a benefit may result even from the movable member 610 without such pinching provisions:

FIG. 36 shows a sheet discharge device 700 using a movable member 710 without such sheet pinching function as mentioned above. The movable member 710 appears identical to the movable member 610 described in FIG. 33, but there are two variations: 1) the main rollers 21 and the followers 15 and 25 as well as the carry rollers 612 and the followers 613 altogether do not have a function to momentarily pinch a leading edge of sheets, and 2) the main rollers 21 are so designed for its clockwise rotation by the motor 620 in FIG. 33 that Numeral 315 can serve as a sheet receive port and Numeral 313 as a sheet discharge port.

Figure 37:
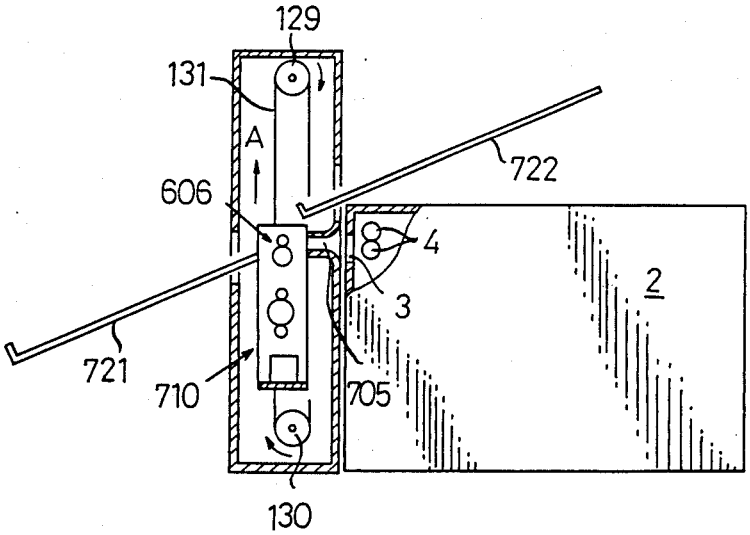

The movable member 710 is so actuated by a copying process controller (not shown) responsible for the copying process control in the copying machine 2, that the movable member 710 can move vertically between two following positions: 1) one position on which the sheet receive port 614 in the sheet carrier 606 can face a sheet receive port 705 receiving sheets discharged from the copying machine 2 as well as the sheet discharge port 615 can face a first paper discharge tray 721 as shown in FIG. 37 (hereafter the position is referred to as the normal paper discharge position), and 2) the other position on which the sheet receive port 315 for the main rollers 21 can face a sheet receive port 705 receiving sheets fed from the copying machine 2 as well as the sheet discharge port 313 can face a second paper discharge tray 722 as shown in FIG. 36 (hereafter the position is referred to as the reverse paper discharge position).

When recorded sheets produced through the continuous copying process by the copying machine 2 are to be successively discharged on the first paper discharge tray 721, the movable member 710 is set to the normal paper discharge position as shown in FIG. 37, when recorded sheets are fed into a pressure-contact portion of the carry rollers 612 and the followers 613 through the paper discharge port 3 and the sheet receive port 705 by means of the pair of paper, discharge rollers 4 in the copying machine 2. Rotation of the rollers 612 and 613 toward the first paper discharge tray 721 allows recorded sheets to be successively discharged and stacked on the first paper discharge tray 721.

When so-called interrupt copying is to be made during the continuous copying process, it is desirable that recorded sheet produced by the interrupt copying be discharged on a separate tray from the first paper discharge tray 721 for continuously copied sheets; in a sheet discharge device 700, the sheet is discharged separately on a second paper discharge tray 722. Following is an a discussion of the operation for the interrupt-copying process:

The movable member 710 is pulled up by the wires 131 (as shown by Arrow A in FIG. 37) to the reverse paper discharge position in FIG. 36 to be set thereto. In this condition, recorded sheet discharged from the pair of paper discharge rollers 4 in the copying machine 2 is fed into the sheet receive port 315 for the main rollers 21. As described above referring to FIG. 33, the rotation of the main rollers 21 and the followers 21 and 25 toward the second paper discharge tray 722 allows recorded sheet fed into the sheet receive port 315 to be carried around the main rollers 21 while being turned over (upside-down), and finally to be discharged on the second paper discharge tray 722 through the sheet discharge port 313. On completion of discharging the interrupt sheet on the second paper discharge tray 722, the movable member 710 is pulled down by the wires 131 (as shown by Arrow B) to the normal paper position in FIG. 37 and reset thereto. In this status, the previous continuous copying having been interrupted for a while restarts to continuously discharge recorded sheets on the previous first paper discharge tray 721.

The above is a description of several embodiments according to the invention, but all the embodiments can easily cope with any positional change of the paper discharge port 3 in a copying machine 2 without providing a special change in construction to the movable member, etc.

Additionally, the carry direction of recorded sheet can be arbitrarily changed by means of the sheet carry direction changer such as the main rollers 21, the followers 15 and 25, the first rollers 106, the second rollers 107 or the like, thus allowing recorded sheets to be discharged in a reverse position or in a slant position to meet slant sheet trays.

It will be clear to those skilled in the art that various changes may be made in the invention without departing from the spirit and scope thereof and therefore the invention is not limited by that which is shown in the drawings and described in the specification but only as indicated in the appended claims.

What is claimed is:

1. A sheet discharge device comprising:

a plurality of sheet trays vertically disposed at predetermined intervals, a movable member disposed adjacent to said sheet trays and movable substantially up and down, lift drive means for raising and lowering said movable member, sheet pinch means disposed on said movable member for momentarily holding sheets discharge to the sheet discharge device, sheet discharge means disposed on said movable member for transferring said sheets to the sheet trays, drive means for driving one of said sheet pinch means and said sheet discharge means, means disposed on said movable member for changing a carrying direction of the sheets transferred by said sheet discharge means, and control means including means for controlling said movable member to stand by a home position to receive a sheet and to move to a target position while holding the sheet received using said sheet pinch means, said control means further including means for controlling said sheet discharge means to discharge the sheet onto a target sheet tray, and means for returning said movable member to said home position from said target position, said drive means for one of said sheet pinch means and said sheet discharge means being disposed on said movable member, and said lift drive means being disposed outside of said movable member.

2. A sheet discharge device as claimed in claim 1 wherein said lift drive means comprises a step motor for raising and lowering said movable member, and wherein said control means includes means for driving said step motor for a predetermined period of time to move said movable member from said home position to said target position.

3. A sheet discharge device comprising:

a plurality of sheet trays vertically disposed at predetermined intervals, a movable member disposed adjacent said sheet trays and movable substantially up and down, lift drive means for raising and lowering said movable member, sheet pinch means disposed on said movable member for momentarily holding sheets discharged to the sheet discharge device, sheet discharge means disposed on said movable member to transfer sheets to the sheet trays, drive means for driving one of said sheet pinch means and said sheet discharge means, means disposed on said movable member for changing a carrying direction of the sheets transferred by said sheet discharge means, and control means including means for controlling said movable member to stand by a home position to receive a sheet and to move to a target position while holding the sheet received using said sheet pinch means, said control means further including means for controlling said sheet discharge means for discharging the sheet onto the target sheet tray and including means for returning said movable member to said home position from said target position, and sheet detecting means disposed on said movable member to detect the sheet fed into said sheet pinch means, said control means controlling said drive means for said sheet pinch means or said sheet discharge means based on when said sheet detecting means detects the sheet.

4. A sheet discharge device as claimed in claim 3, wherein said drive means for one of said sheet pinch means and said sheet discharge means is disposed on said movable member.

5. A sheet discharge device comprising:

a plurality of sheet trays vertically disposed at given intervals, a movable member disposed adjacent to said sheet trays and movable up and down, lift drive means for raising and lowering said movable member, sheet pinch means disposed on said movable member for momentarily holding sheets discharged to the sheet discharge device, sheet discharge means disposed on said movable member to transfer sheets to the sheet trays, drive means for driving said sheet pinch means of said sheet discharge means, means disposed on said movable member for changing a carrying direction of the sheets transferred by said sheet discharge means, and control means including means for controlling said movable member to stand by a home position to receive a sheet and to move to a target position while holding the sheet received using said sheet pinch means, said control means further including means for controlling said sheet discharge means to discharge the sheet onto the target receptacle means for returning said movable member to said home position from said target position and means for controlling said lift drive means so that the speed of said movable member is faster than the discharge speed of the sheet transferred from an image recording machine.

6. A sheet discharge device as claimed in claim 5, wherein said control means includes means for controlling said lift drive means so that the speed at which said movable member moves from said home position to said target position is substantially the same as the discharge speed of the recorded sheet transferred from the image recording machine, and so that the speed at which said movable member returns from said target position to said home position is faster than said sheet discharge speed from the image recording machine.

7. A sheet discharge device as claimed in claim 6, wherein said lift drive means comprises a step motor for raising and lowering said movable member, and wherein said control means includes means for driving said step motor for a predetermined period of time to move said movable member from said home position to said target position.

8. A sheet discharge device as claimed in claim 5, wherein said lift drive means comprises a step motor for raising and lowering said movable member, and wherein said control means includes means for driving said step motor for a predetermined period of time to move said movable member from said home position to said target position.

9. A sheet discharge device comprising:

a plurality of sheet trays vertically disposed at given intervals, a movable member disposed close to said sheet trays and movable up and down, lift drive means for raising and lowering said movable member, sheet pinch means disposed on said movable member to momentarily hold sheets discharged to the sheet discharge device, sheet discharge means disposed on said movable member to transfer sheets to the sheet trays, drive means for driving one of said sheet pinch means disposed on said movable member for changing a carrying direction of the sheets transferred by said sheet discharge means, and control means including means for controlling said movable member to stand by a given home position to receive a sheet and to move to a target position while holding the sheet received using said sheet pinch means, said control means further including means for controlling said sheet discharge means to discharge the sheet onto the target sheet tray and means for returning said movable member to said home position from said target position, said sheet pinch means including means for preventing the sheet held by said sheet pinch means from being drawn out of said recorded sheet pinch means.

10. A sheet discharge device as claimed in claim 9, wherein said sheet pinch means comprises a pair of rollers for holding the sheet, and wherein said means for preventing the sheet from being drawn out comprises means for preventing said pair of rollers from rotating in a direction opposite to the sheet discharging direction.

11. A sheet discharge device comprising:

a plurality of sheet trays vertically disposed at given intervals, a movable member disposed close to said sheet trays and movable up and down, lift drive means for raising and lowering said movable member, sheet pinch means disposed on said movable member to momentarily hold sheets discharge to the sheet discharge device, sheet discharge means disposed on said movable member to transfer sheets to the sheet trays, drive means for driving one of said sheet pinch means and said sheet discharge means, means disposed on said movable member for changing a carrying direction of the sheets transferred by said sheet discharge means, and control means including means for controlling said movable member to stand by a home position to receive a sheet and to move to a target position while holding the sheet received using said sheet pinch means, said control means further including means for controlling said sheet discharge means to discharge the recorded sheet onto the target sheet tray and means for returning said movable member to said home position from said target position, said home position being located to match a lowest sheet tray among said plurality of receptacles.

* * * * *